US008807028B2

(12) United States Patent
Hutchison et al.

(10) Patent No.: US 8,807,028 B2
(45) **Date of Patent: *Aug. 19, 2014**

(54) MAGNETIC CHASE AND GRAPHIC ARTS DIE ASSEMBLY WITH A SELECTIVELY ACTUATABLE MEANS FOR RAISING AND SUPPORTING THE DIE PLATE DURING ALIGNMENT

(75) Inventors: Larry Hutchison, Overland Park, KS (US); Derek Smith, West Sussex (GB); Todd E. Scholtz, Olathe, KS (US)

(73) Assignee: Universal Engraving, Inc., Overland Park, KS (US)

( * ) Notice: Subject to any disclaimer, the term of this patent is extended or adjusted under 35 U.S.C. 154(b) by 91 days.

This patent is subject to a terminal disclaimer.

(21) Appl. No.: 13/437,598

(22) Filed: Apr. 2, 2012

(65) Prior Publication Data

US 2012/0186471 A1 Jul. 26, 2012

Related U.S. Application Data

(63) Continuation of application No. 12/103,610, filed on Apr. 15, 2008, now Pat. No. 8,146,494.

(60) Provisional application No. 60/914,621, filed on Apr. 27, 2007.

(51) Int. Cl.

| | |
|---|---|
| ***B41B 1/18*** | (2006.01) |
| ***B41F 27/02*** | (2006.01) |
| ***B41F 27/00*** | (2006.01) |
| ***B26F 1/44*** | (2006.01) |
| ***B44B 5/02*** | (2006.01) |
| *B26F 1/40* | (2006.01) |
| *B26D 7/26* | (2006.01) |

(52) U.S. Cl.

CPC ..... *B41F 27/005* (2013.01); *B41F 27/02* (2013.01); *B26F 1/44* (2013.01); *B26F 1/40* (2013.01); *B44B 5/026* (2013.01); *B26D 2007/2607* (2013.01); *B26D 7/2614* (2013.01)

USPC ..... 101/391; 101/390

(58) Field of Classification Search

USPC ..... 101/390–394

See application file for complete search history.

(56) References Cited

U.S. PATENT DOCUMENTS

| | | | | |
|---|---|---|---|---|
| 4,233,873 | A * | 11/1980 | Jessen | 83/652 |
| 4,466,248 | A * | 8/1984 | Nartowski | 60/602 |
| 4,777,463 | A * | 10/1988 | Cory et al. | 335/289 |
| 5,340,528 | A * | 8/1994 | Machida et al. | 264/328.7 |
| 5,800,590 | A * | 9/1998 | Pilskar | 65/158 |
| 6,062,140 | A * | 5/2000 | McEachern | 101/389.1 |
| 6,152,035 | A * | 11/2000 | Scholtz et al. | 101/389.1 |
| 6,250,475 | B1 * | 6/2001 | Kwasniewicz et al. | 209/229 |
| 2002/0043161 | A1 * | 4/2002 | Hutchison et al. | 101/28 |
| 2002/0046662 | A1 * | 4/2002 | Hutchison et al. | 101/3.1 |
| 2002/0083856 | A1 * | 7/2002 | Hutchison et al. | 101/368 |
| 2003/0019376 | A1 * | 1/2003 | Gary, IV | 101/226 |

* cited by examiner

*Primary Examiner* — David Banh

(74) *Attorney, Agent, or Firm* — Hovey Williams LLP

(57) ABSTRACT

A graphic arts die assembly and chase for use in a graphic arts press are disclosed for use in conjunction with a press. The die assembly includes a die plate formed at least partially of ferromagnetic material and a chase with a plurality of magnet assemblies configured to provide a magnetic coupling force to selectively secure the die plate to the chase. The chase includes an actuatable releasing assembly to exert a disengagement force to separate the magnetic securement between the plates.

76 Claims, 17 Drawing Sheets

MAGNETIC CHASE AND GRAPHIC ARTS DIE ASSEMBLY WITH A SELECTIVELY ACTUATABLE MEANS FOR RAISING AND SUPPORTING THE DIE PLATE DURING ALIGNMENT

CROSS-REFERENCE TO RELATED APPLICATION

This is a continuation of application Ser. No. 12/103,610, filed Apr. 15, 2008, which claims the benefit of and priority from U.S. Provisional Patent Application Ser. No. 60/914,621, filed Apr. 27, 2007, the entire disclosure of each of which is hereby incorporated by reference herein.

BACKGROUND OF THE INVENTION

1. Field of the Invention

The present invention relates generally to the support and release of a graphic arts die plate on an assembly for use in a press. More specifically, the present invention concerns a die assembly wherein a die plate is carried by a magnetic chase and held in position thereon through magnetic securement by a series of magnets embedded in the chase. The assembly has particular utility for use in flatbed graphic arts presses to be used for hot foil stamping, die cutting, or embossing. In a preferred embodiment, the magnetic chase is substituted for a conventional apertured chase of a press. A selectively actuatable releasing assembly is employed to elevate the die plate to a magnetically disengaged position above the magnetic chase to facilitate alignment of the die plate with images on a substrate to be processed in the press.

2. Discussion of the Prior Art

Those of ordinary skill in the art will appreciate that it has long been the practice, where multiple hot foil stamping, die cutting, and/or embossing dies are to be mounted on an apertured flat chase, to secure each die to the chase using a plurality of toggle connectors. Traditionally, each toggle is inserted into an aperture of the chase adjacent the perimeter of a corresponding die. Sufficient toggles are provided for each die to assure a secure fixation of that die to the chase. It is not uncommon to have as many as ten to twenty or more dies arranged on a single chase, depending on the number of images to be hot foil stamped, die cut, or embossed. An apertured chase for multiple image applications can commonly have a size of forty by twenty-seven inches, or be even larger.

Conventionally, each die is positioned on the apertured chase in approximate registration with a respective substrate image to be hot foil stamped, die cut, or embossed. After all of the dies are secured to the chase with toggles, the chase (with the engraving dies mounted thereon) is "run in" against the image-bearing substrate to ascertain whether the dies are in fact properly aligned with respective images. Most usually, some further adjustment of the individual dies is required to obtain the necessary registration. This hit-or-miss procedure is repeated until all of the dies are each finally registered with their images. Even experienced graphic arts press operators will normally need at least three to eight hours of time to mount a number of dies on an apertured support chase using individual toggles and to align and realign all of the dies until they are in final register with the substrate images.

U.S. Pat. No. 7,096,709 ("the '709 patent"), hereby incorporated by reference in its entirety, to the extent not inconsistent with the present disclosure, discloses a graphic arts die and die carrier plate assembly that is adapted to be mounted as a unit on an apertured chase of a flatbed graphic arts press.

The assembly of the '709 patent has particular utility for hot foil stamping, die cutting, and substrate embossing applications, or combinations thereof. Each of the dies of the assembly is fixedly mounted in predetermined relative relationship on a flat, metal die carrier plate. Fasteners for each die are pre-attached to the die carrier plate in disposition such that when respective dies are secured to the plate, the die images all align with one another and, if applicable, with respect to artwork on a substrate.

Thus, those of ordinary skill in the art will appreciate that using the graphic arts die and die carrier plate assembly of the '709 patent, commercialized by, or under the auspices of, Universal Engraving, Inc. of Overland Park, Kans. (the assignee of record of the '709 patent and the present application) as its UniLock-Up system, a large number of individual dies may all be mounted in predetermined, preregistered relationship on a die carrier plate that is then secured to a conventional apertured chase. Significant time is saved using the UniLock-Up system as compared with prior conventional methods because only about an hour is required to align and attach all of the dies to the die carrier plate. To this end, the fasteners for the dies are secured to the die carrier plate in predetermined disposition based on the locations of respective substrate artwork images.

As explained in greater detail in the disclosure of the '709 patent, each of the individual dies may be shifted to a minor extent to obtain necessary registration with respective substrate images. Such minor adjustment, though, requires only loosening of threaded members, such as screws or threaded nuts, followed by re-tightening of the screws or threaded nuts after the die has been shifted, rather than loosening and tightening of toggles, or even in some instances re-positioning of the toggles. One important advantage of preregistration of the dies on the die carrier plate is the fact that such plate, with the dies thereon, may be stored for use at later times without the necessity of once again registering the dies as has conventionally been necessary.

SUMMARY

The present invention takes advantage of some of the features and mounting procedures of the UniLock-Up system disclosed in the '709 patent and is an improvement thereover in that the time required to mount a die carrier plate having preregistered dies is further significantly reduced. This is primarily attributable to the principles of the present invention and the elimination of the toggle connectors conventionally used to secure the dies or a die carrier plate to the chase. The new system broadly consists of a chase that is preferably a replacement for a conventional apertured chase. Alternatively, the chase may be constructed to be mounted on or within a conventional press chase.

According to one aspect of the present invention, a graphic arts die assembly is provided for mounting on a graphic arts impression apparatus. The assembly includes a die plate formed at least partially of ferromagnetic material and including a die. The assembly also includes a chase with a plurality of magnet assemblies disposed along an engagement surface thereof. The die plate and magnet assemblies are configured to provide a magnetic coupling force for selectively securing the die plate to the engagement surface of the chase such that relative movement between the chase and the die plate is restricted during such magnetic securement. The chase also includes an actuatable releasing assembly thereon that is operable to exert a disengagement force in opposition to the magnetic coupling force so as to selectively lift the die plate from the chase when the releasing assembly is actuated, thereby releasing the magnetic securement between the chase and the die plate and facilitating relative movement between the plates.

Another aspect of the present invention concerns a chase for use in a graphic arts press, wherein the member includes a body with an engagement surface thereon configured to engage a die plate formed at least partially of ferromagnetic material and including a die. A plurality of magnet assemblies are disposed along the engagement surface of the body, such that a magnetic coupling force is configured to selectively secure the die plate to the engagement surface of the body and relative movement between the body and the die plate is restricted during magnetic securement of the die plate on the body. The chase also includes an actuatable releasing assembly that is operable to exert a disengagement force in opposition to the magnetic coupling force so as to selectively lift the die plate from the body when the releasing assembly is actuated, thereby releasing the magnetic securement between the body and the die plate and facilitating relative movement between the body and the die plate.

The chase, whether it be a chase substitute or mounted on an apertured chase, is generally provided with a plurality of embedded and strategically located magnets or magnetic assemblies that serve to fixedly magnetically secure a die or a die carrier plate to the chase. In one embodiment, an actuatable releasing assembly is included in the chase to exert a disengagement force in opposition to the coupling force of the magnetic securement. Once a die carrier plate bearing an array of dies thereon is mounted on the chase and secured in position by the magnets in overlying relationship to at least a part of the releasing assembly, the releasing assembly may be actuated to exert the disengagement force in opposition to the magnetic coupling force to lift the die carrier plate from the engagement surface of the chase, permitting the die carrier plate to be shifted through a displacement to bring the die carrier plate into alignment with alignment pins disposed on the chase.

A die carrier plate, for example, with the engraving dies thereon, may be easily shifted into aligned relationship with the alignment pins because the die carrier plate rides on part of the releasing assembly in a hover position over the chase. The alignment pins may be positioned for edge engagement with the die carrier plate, or the pins may be located to be received in respective alignment holes located within the die carrier plate. Upon alignment of the die carrier plate using the alignment pins, the releasing assembly is deactivated, whereby the die carrier plate settles down against the chase and is securely held in position by the plurality of magnets.

Various other aspects and advantages of the present invention will be apparent from the following detailed description of the preferred embodiments and the accompanying drawing figures.

This summary is provided to introduce a selection of concepts in a simplified form that are further described below in the detailed description of the preferred embodiments. This summary is not intended to identify key features or essential features of the claimed subject matter, nor is it intended to be used to limit the scope of the claimed subject matter.

BRIEF DESCRIPTION OF THE DRAWING FIGURES

A preferred embodiment of the present invention is described in detail below with reference to the attached drawing figures, wherein.

Figure 1:
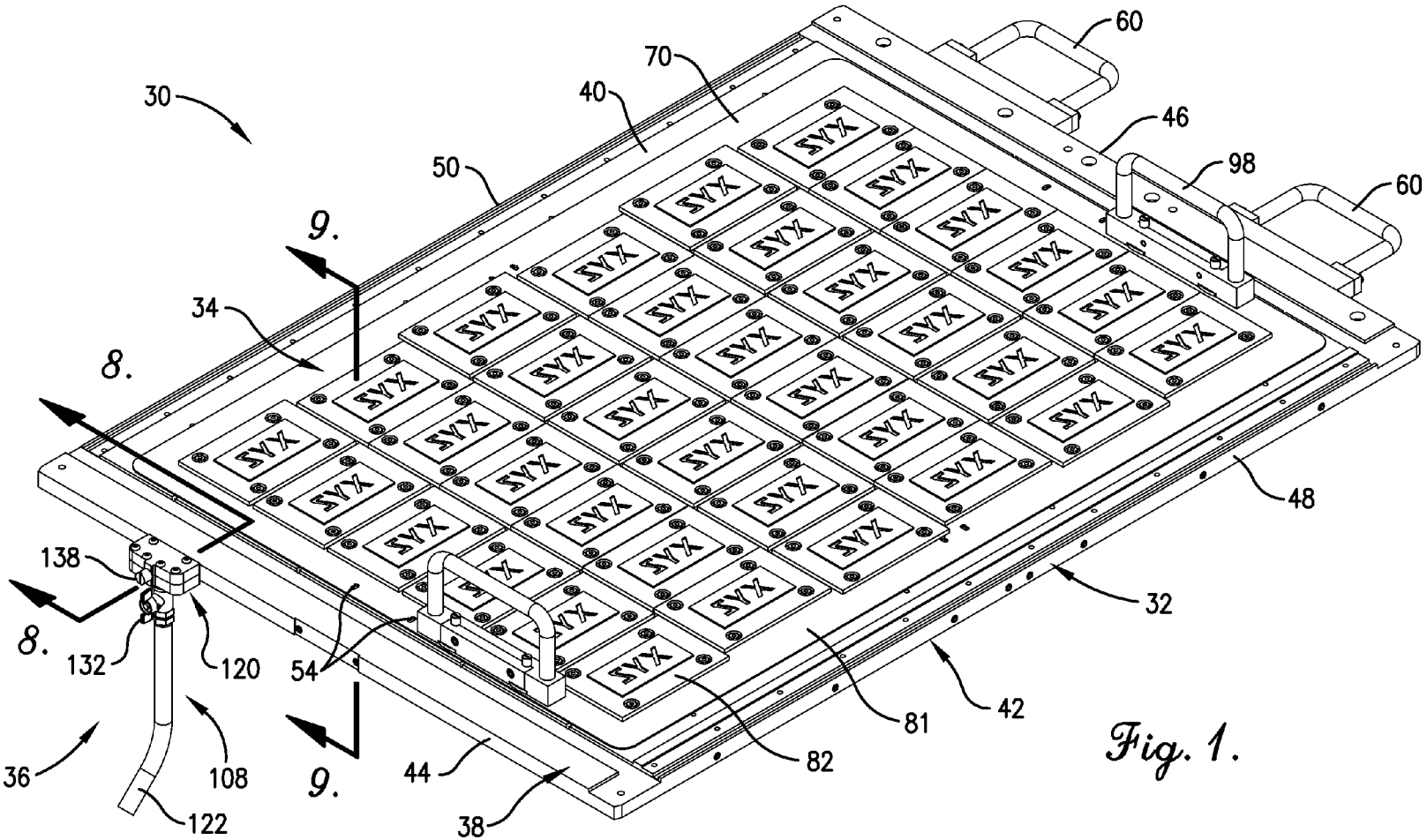
FIG. 1 is a perspective view of a graphic arts die supporting assembly for use in a flatbed graphic arts press constructed in accordance with the principles of a preferred embodiment of the present invention, shown with a plurality of individual dies thereon and a compressed air coupler connected thereto.
Figure 3A:
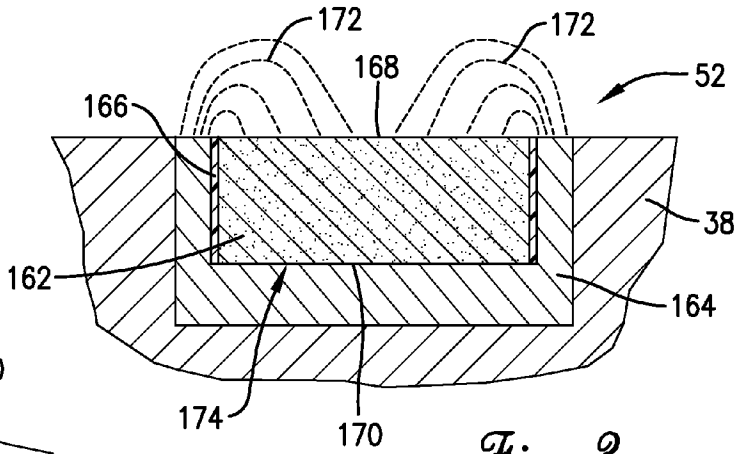
FIG. 3 is an enlarged, fragmentary, perspective view of the graphic arts die supporting assembly shown in FIG. 2, particularly illustrating in detail a portion of the engagement surface of the chase, including magnet assemblies, alignment pins, a plurality of pistons in an extended position, and the compressed air coupler with an associated inlet on the chase.
Figure 3:
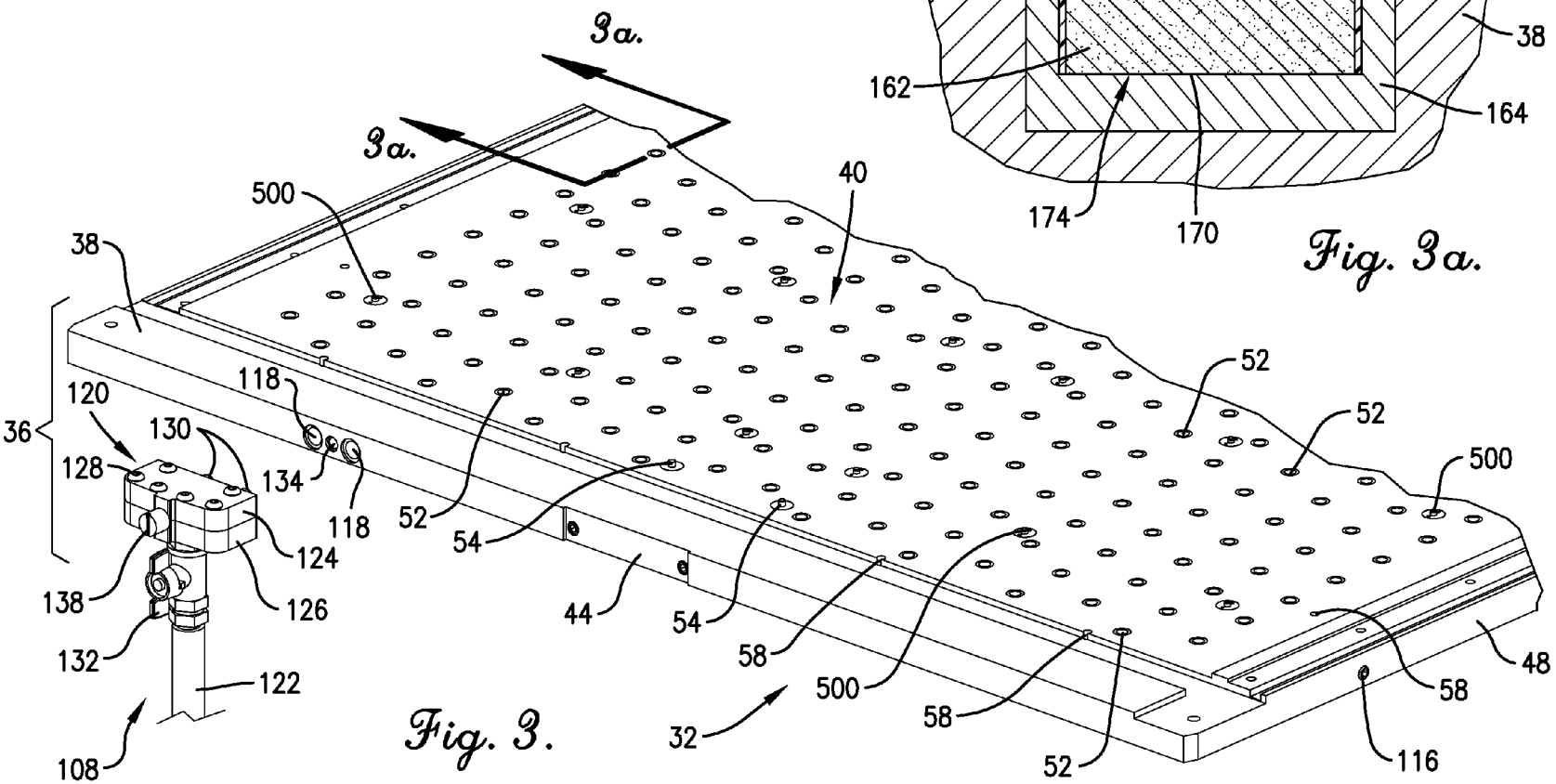
Figure 5:
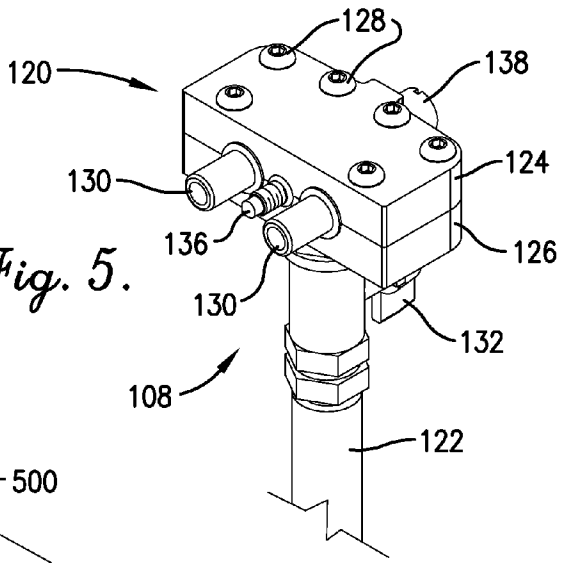
Figure 4:
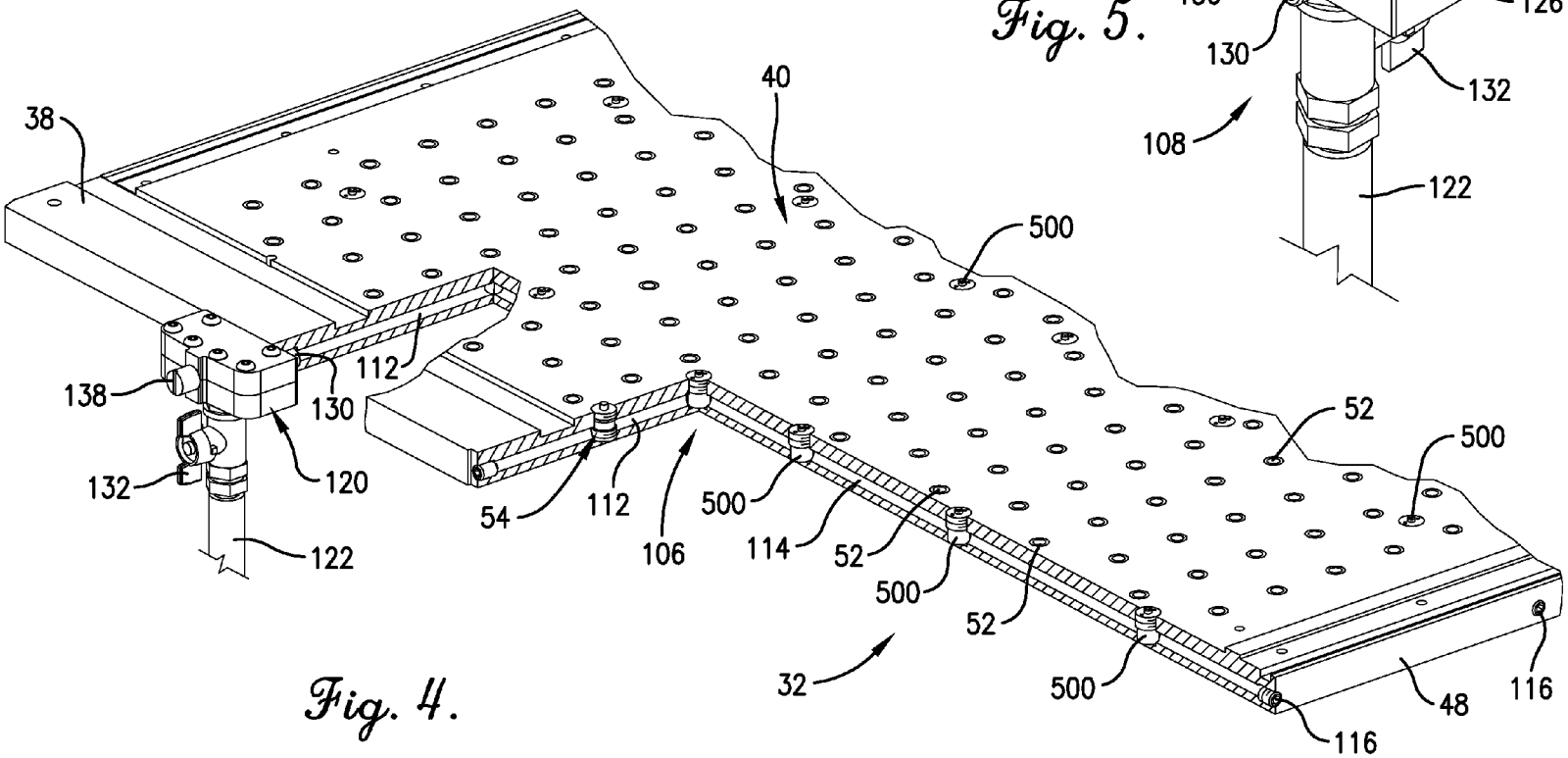
Figure 6:
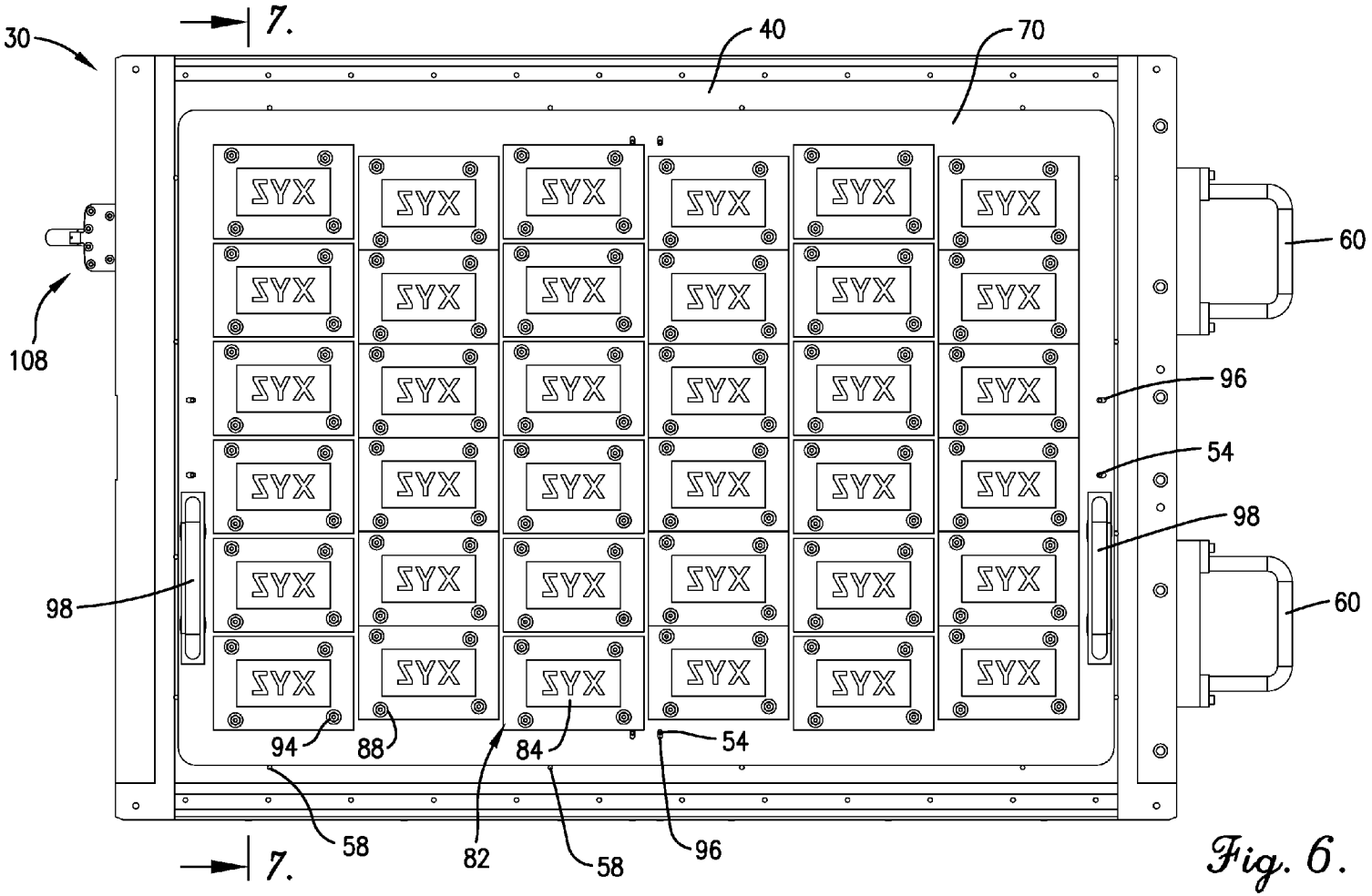
Figure 7:
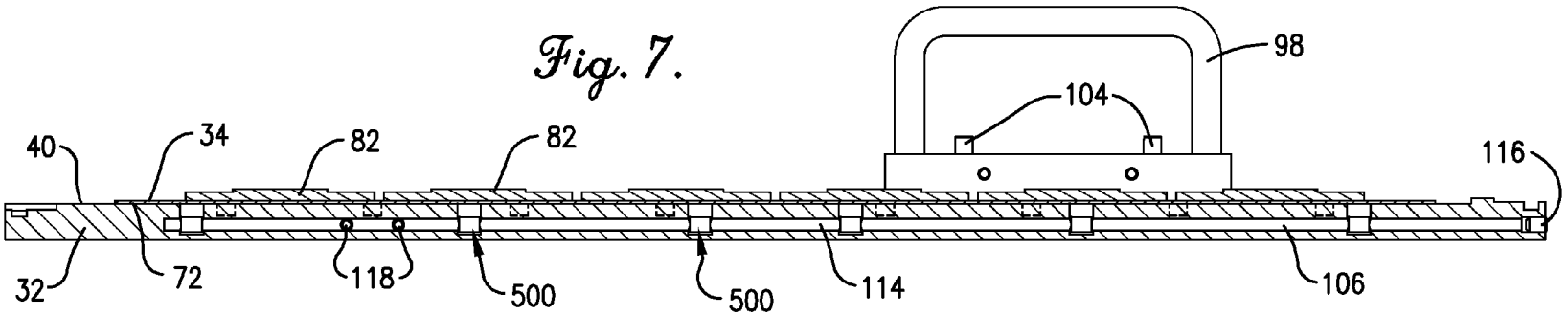
Figure 8:
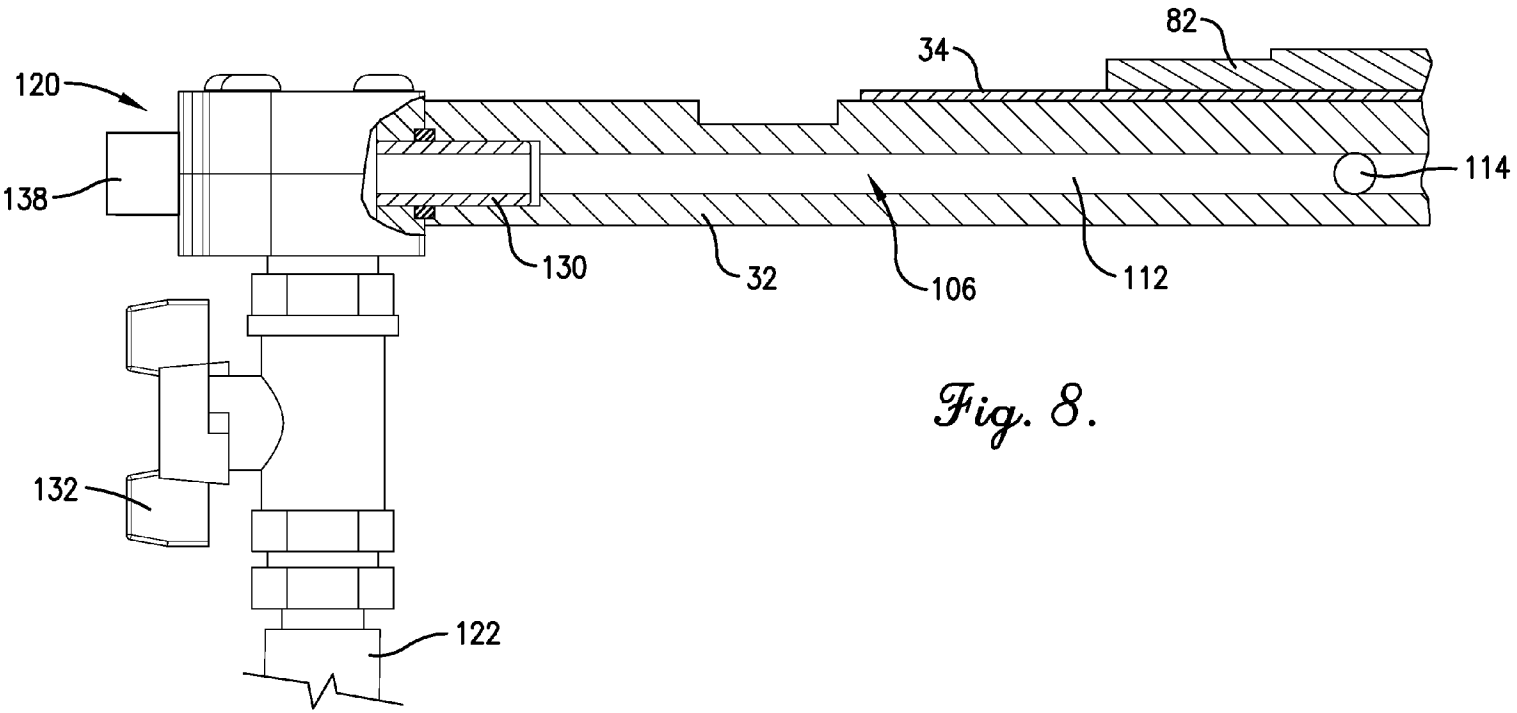
Figure 9:
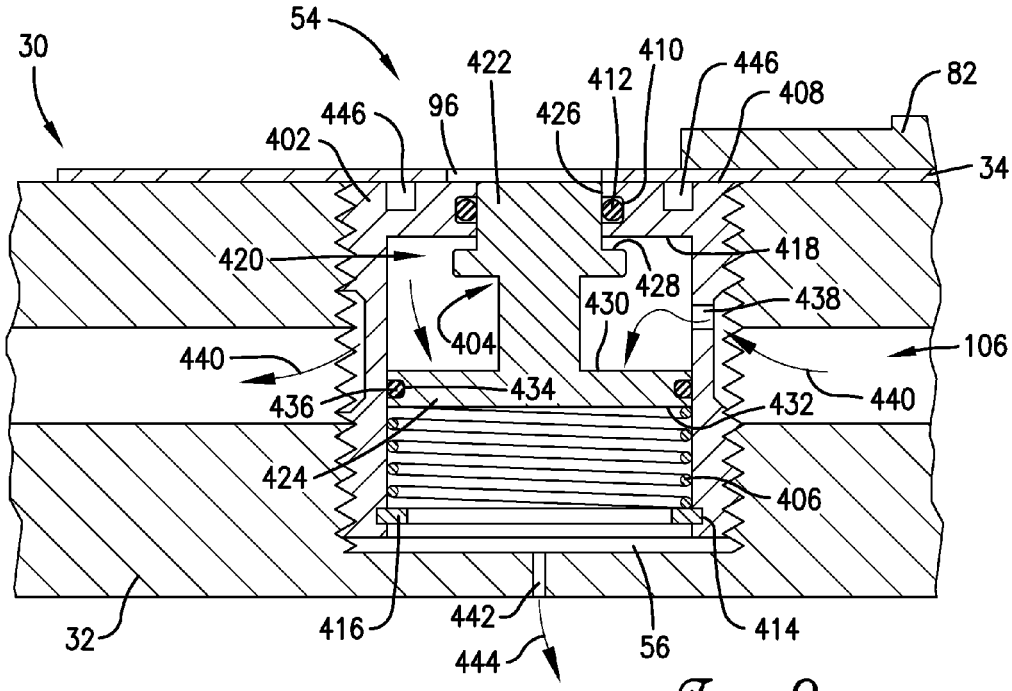

FIG. 3*a* is an enlarged, fragmentary, vertical sectional view of the chase of the graphic arts die supporting assembly, the view taken along the line 3*a*-3*a* of FIG. 3, particularly illustrating in detail one of the magnet assemblies of the chase, with an approximation of the force of the magnetic flux depicted in broken lines;

FIG. 4 is an enlarged, fragmentary, perspective view of the graphic arts die supporting assembly, similar to that of FIG. 3, but with portions of the chase cut away, particularly illustrating in detail a manifold of air passageways disposed within the chase and in communication with the pistons and the alignment pins, and the compressed air coupler associated with the inlet on the chase and the manifold therein;

FIG. 5 is an enlarged, fragmentary, perspective view of the compressed air coupler shown in FIG. 3, presented from the opposite vantage point, particularly illustrating a pair of air distribution openings and an attachment screw to secure the coupler to the chase;

FIG. 6 is a top-down plan view of the graphic arts die supporting assembly shown in FIG. 1, particularly illustrating a plurality of alignment pins on the chase received in corresponding alignment holes in the die plate;

FIG. 7 is an enlarged, partial vertical sectional view of the graphic arts die supporting assembly, the view taken along the line 7-7 of FIG. 6, particularly illustrating in detail a portion of the manifold and pistons associated therewith in the chase and the die plate disposed on the engagement surface of the chase in magnetic securement thereto;

FIG. 8 is an enlarged, fragmentary, partial vertical sectional view of the graphic arts die supporting assembly, the view taken along the line 8-8 of FIG. 1, particularly illustrating in detail a portion of the manifold within the chase and the compressed air coupler secured to the chase and in communication with the manifold;

FIG. 9 is an enlarged, fragmentary, partial vertical sectional view of the graphic arts die supporting assembly, similar in many respects to the view of FIG. 7, with a view taken along the line 9-9 of FIG. 1, depicting in detail an air-released alignment pin assembly received within a threaded hole of the chase and with the hole in communication with the manifold of air passageways, wherein the pin is disposed in a retracted position upon flow of compressed air through the manifold and an aligning portion of the pin is spaced below the engagement surface of the chase, with the die plate disposed on the engagement surface of the chase in magnetic securement thereto.

Figure 10:
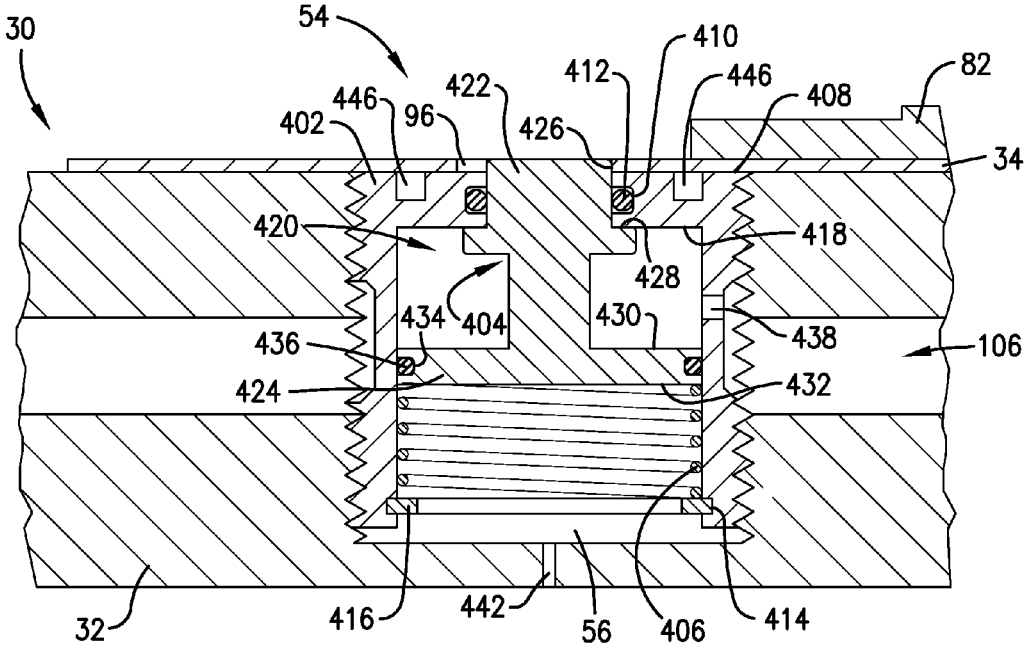

FIG. 10 is an enlarged, fragmentary, partial vertical sectional view of the graphic arts die supporting assembly of FIG. 9, but depicting the air-released alignment pin assembly with the pin disposed in a projecting position and the aligning portion of the pin is spaced above the engagement surface of the chase and being received in a corresponding alignment slot in the die plate.

Figure 11:
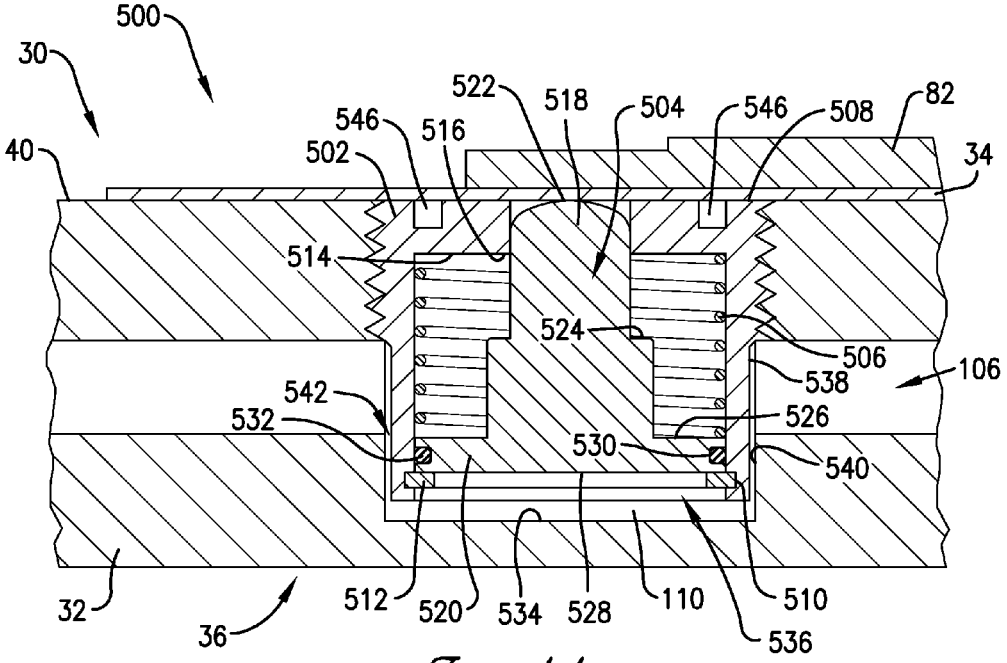
Figure 12:
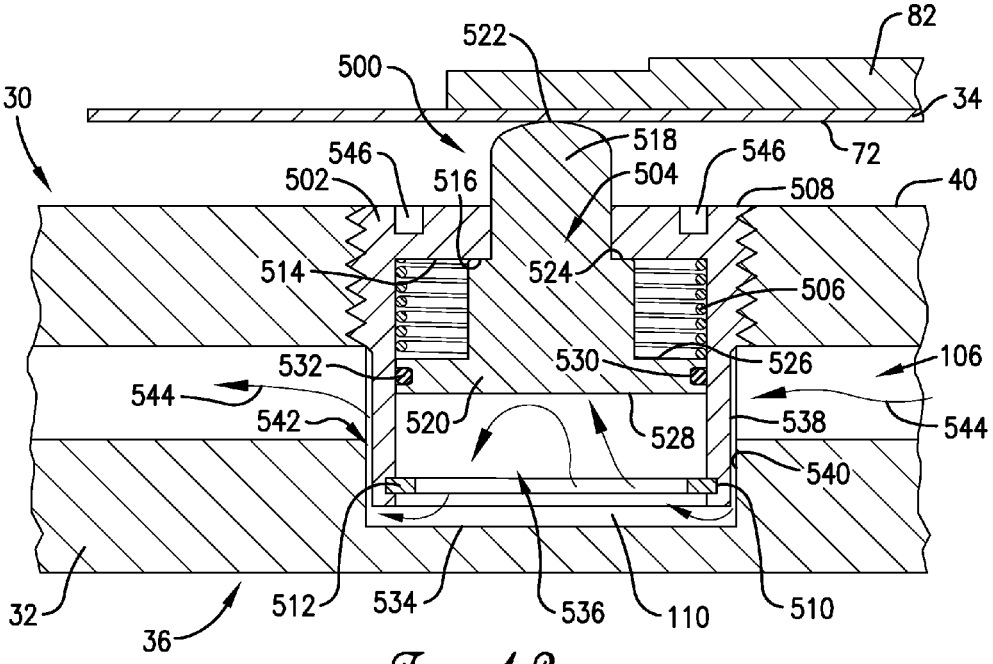
Figure 13:
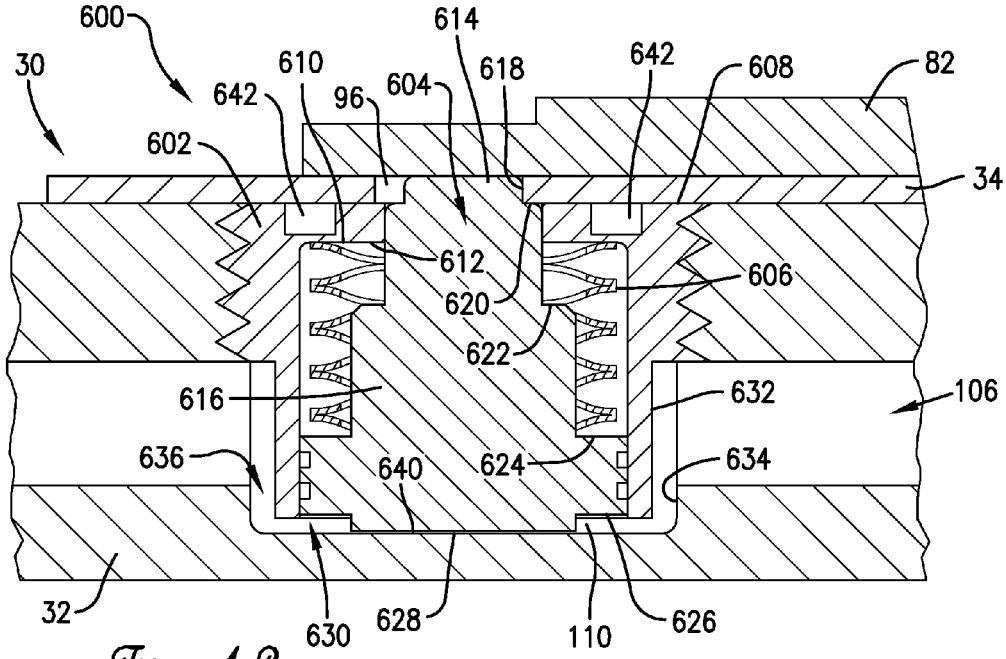
Figure 14:
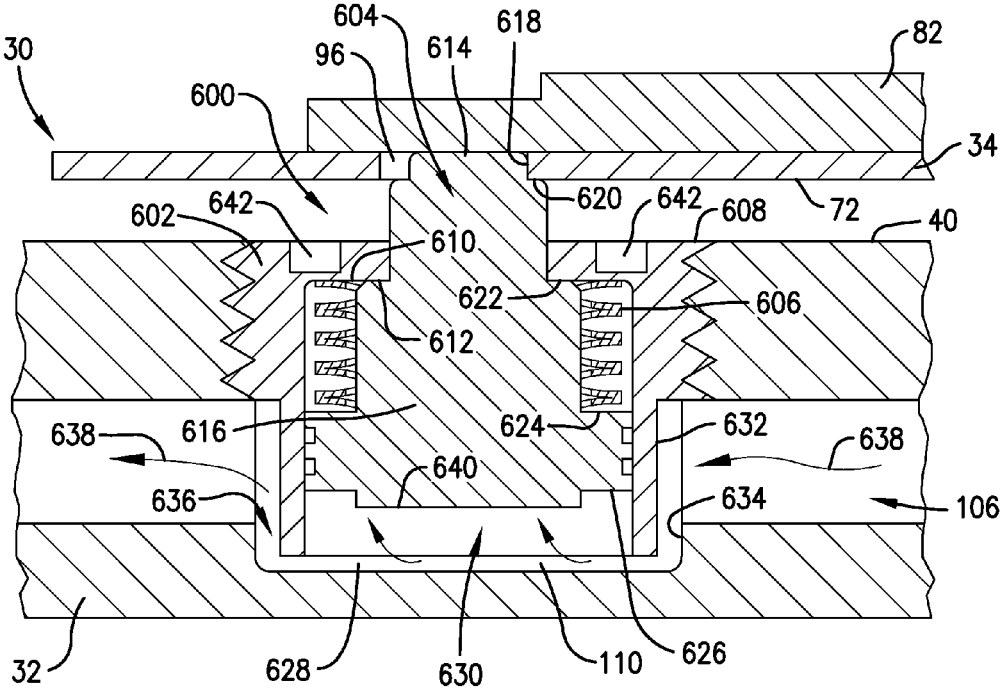
Figure 15:
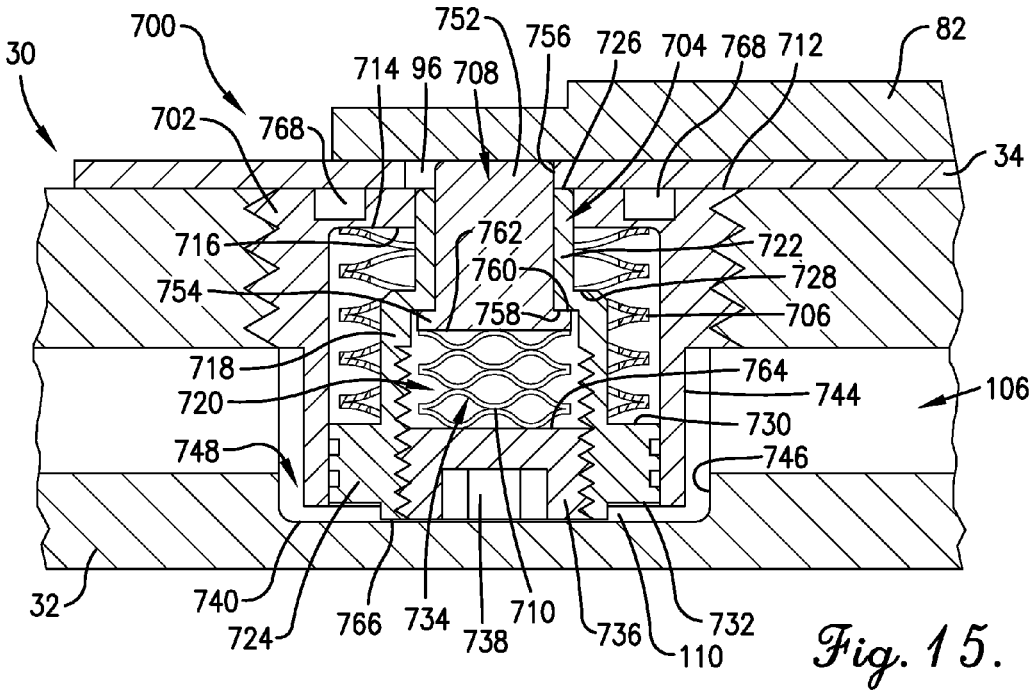
Figure 16:
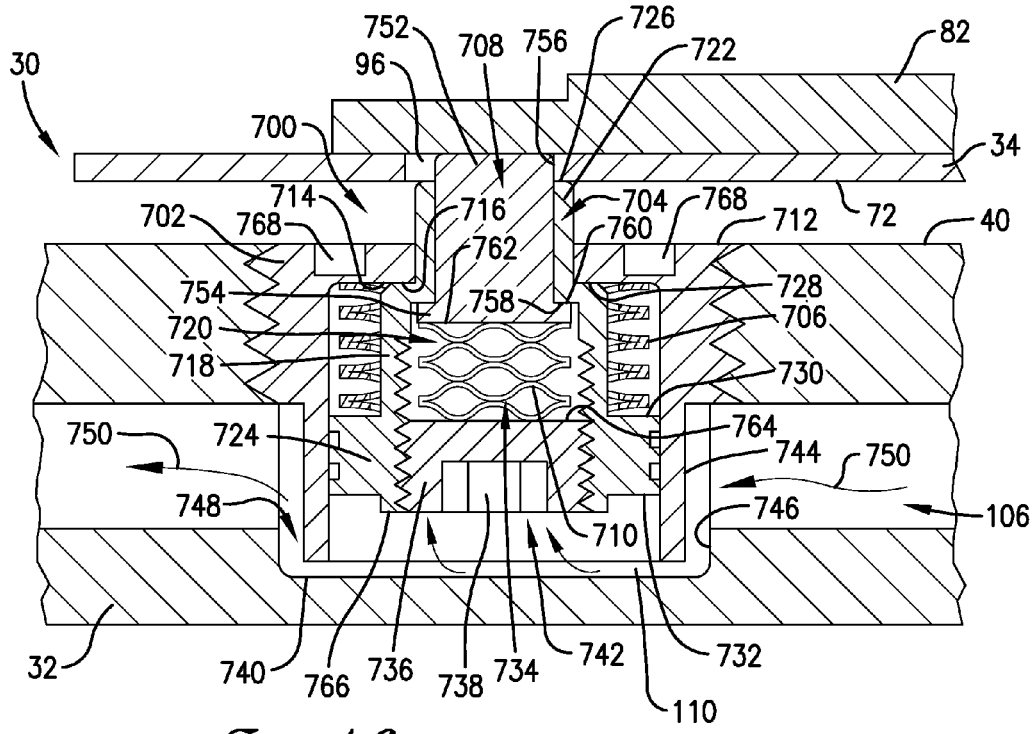
Figure 17:
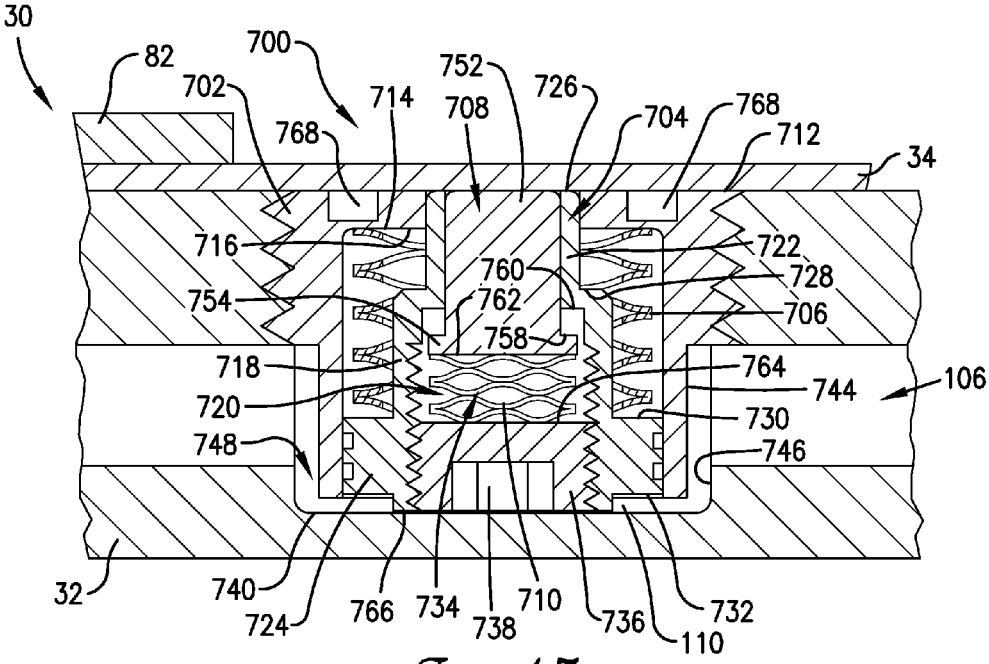
Figure 18:
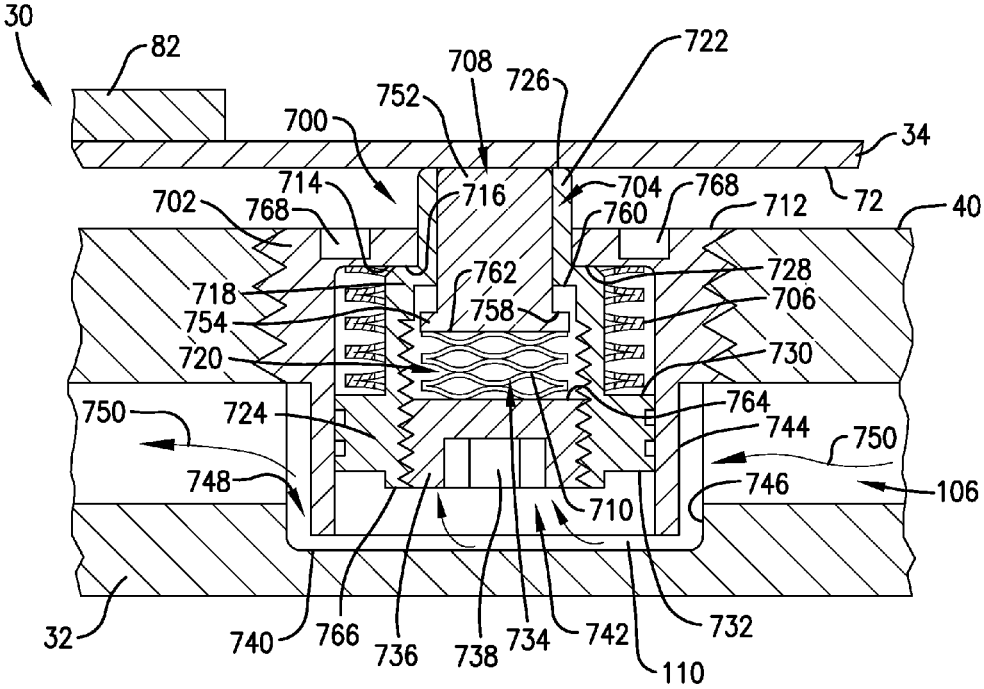
Figure 19:
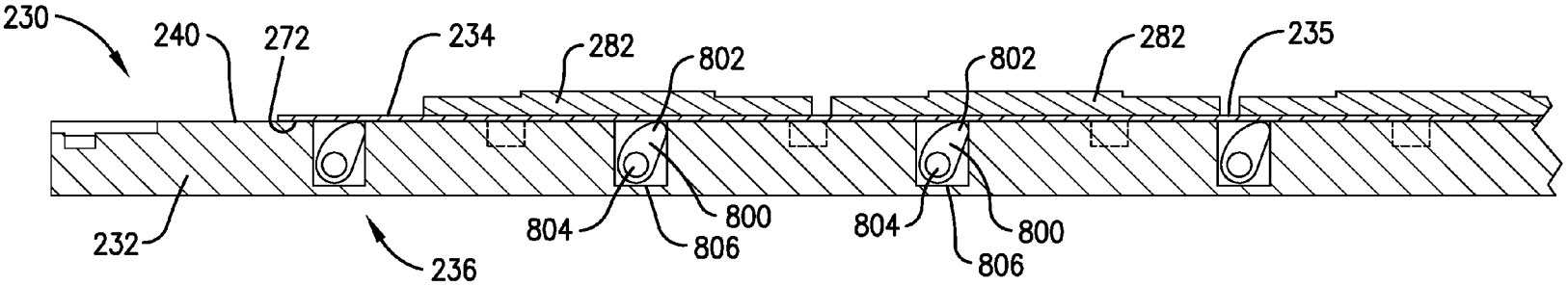
Figure 20:
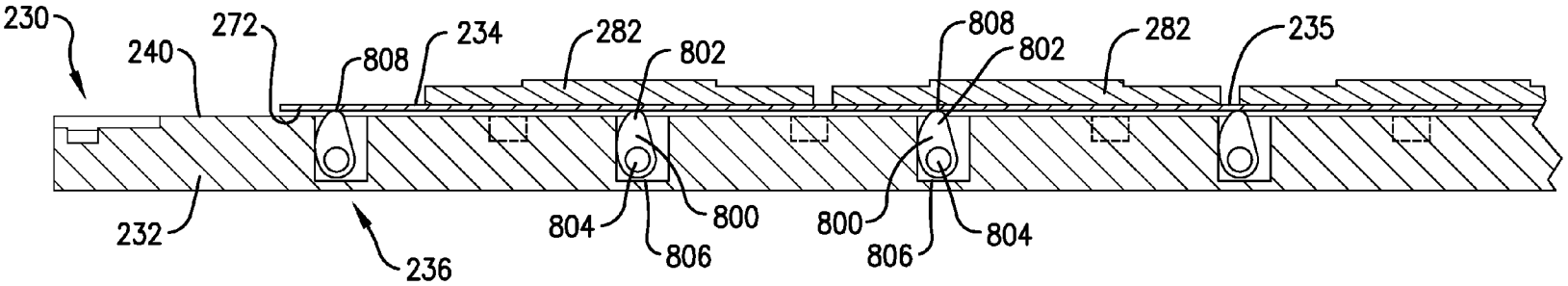
Figure 21:
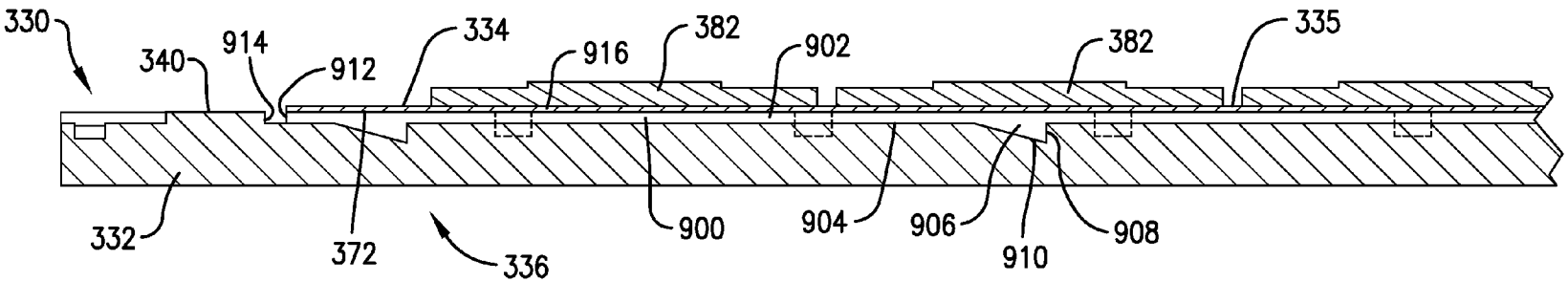
Figure 22:
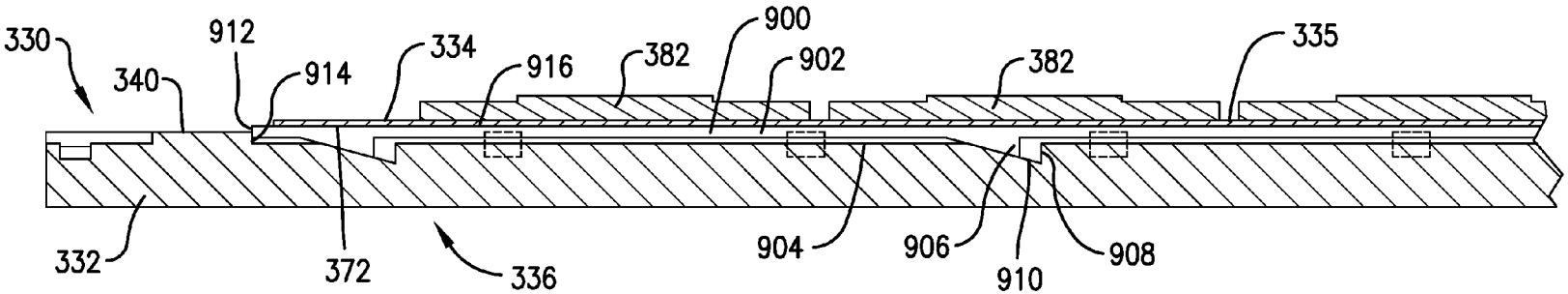
Figure 23:
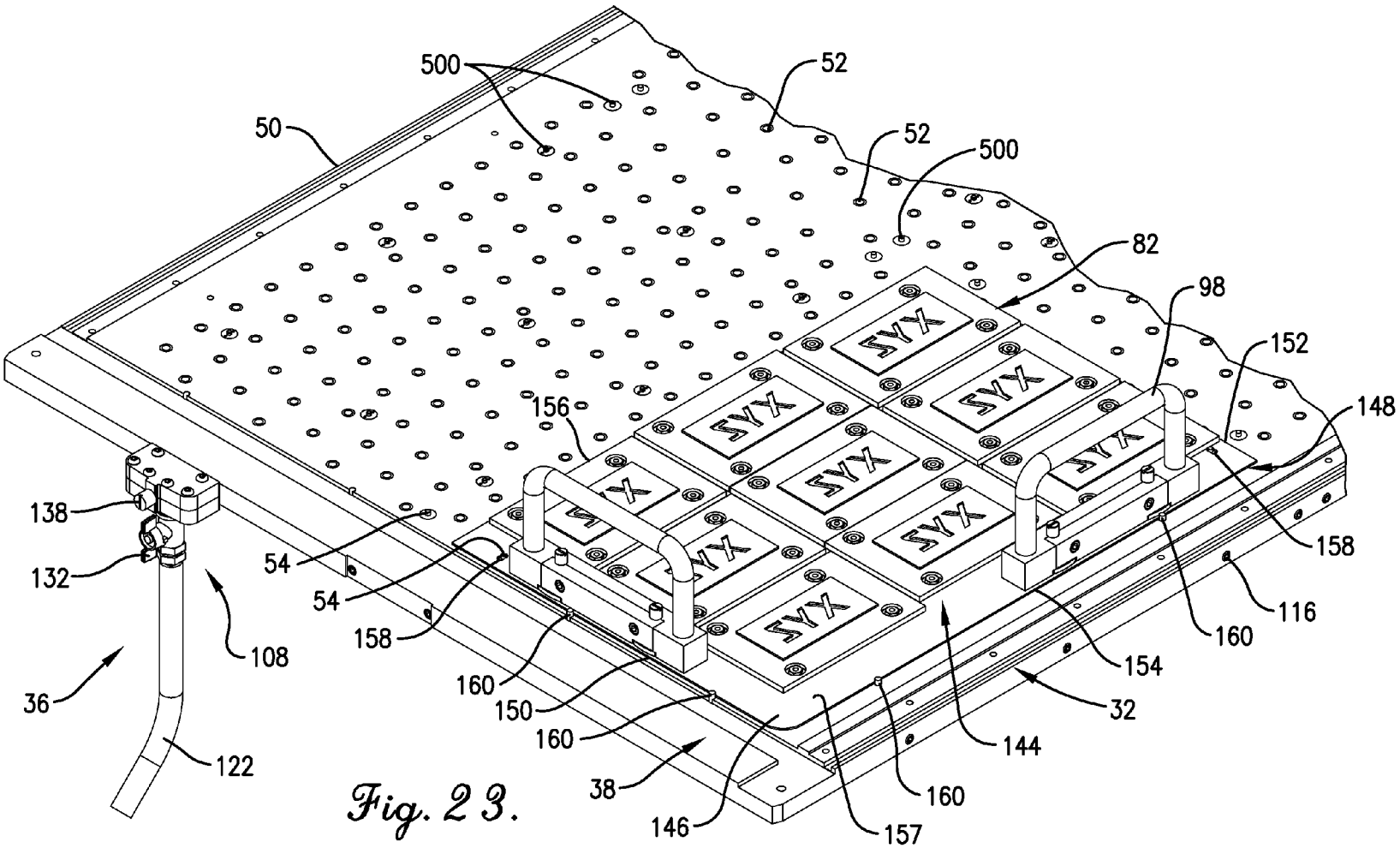
Figure 24:
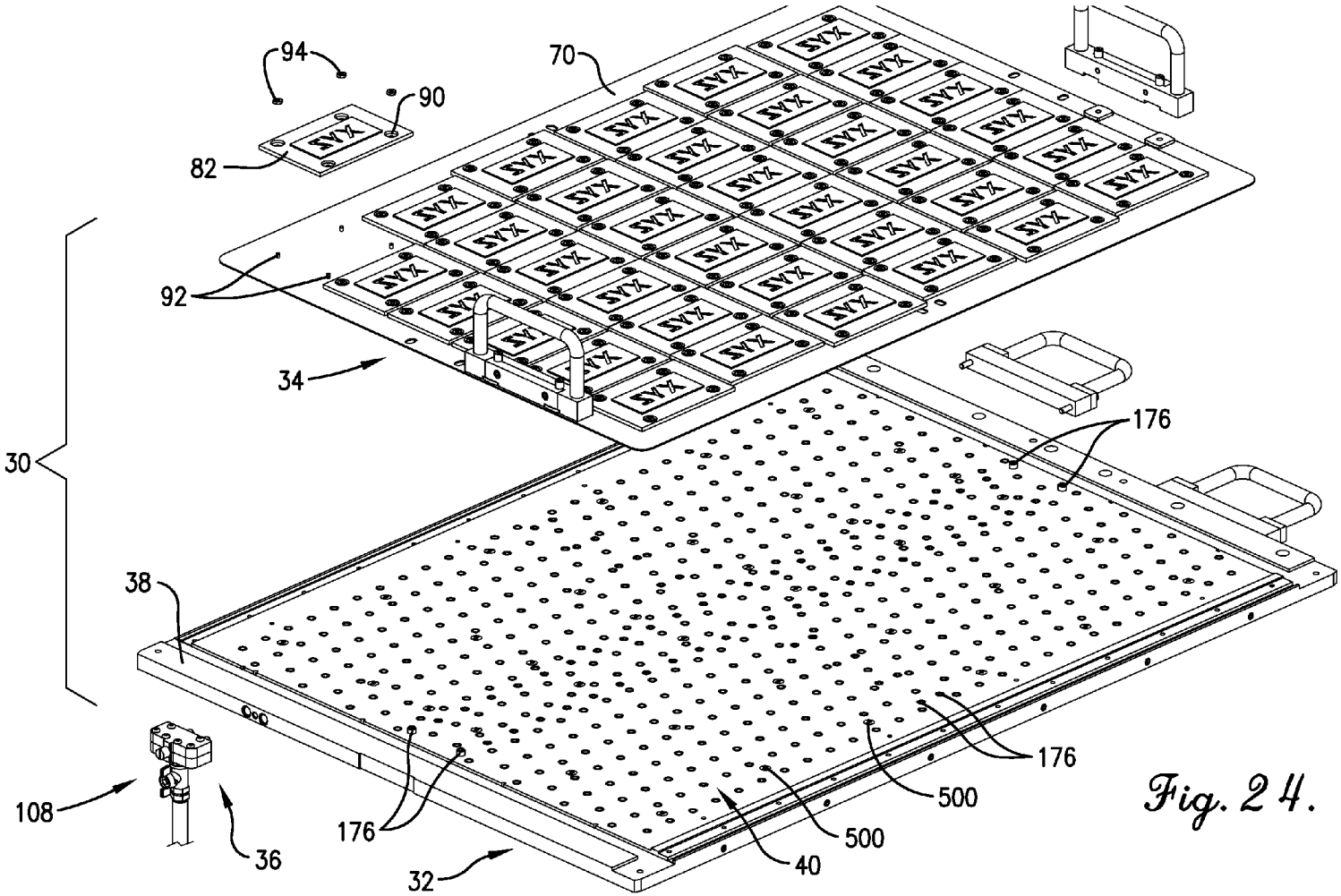
Figure 25:
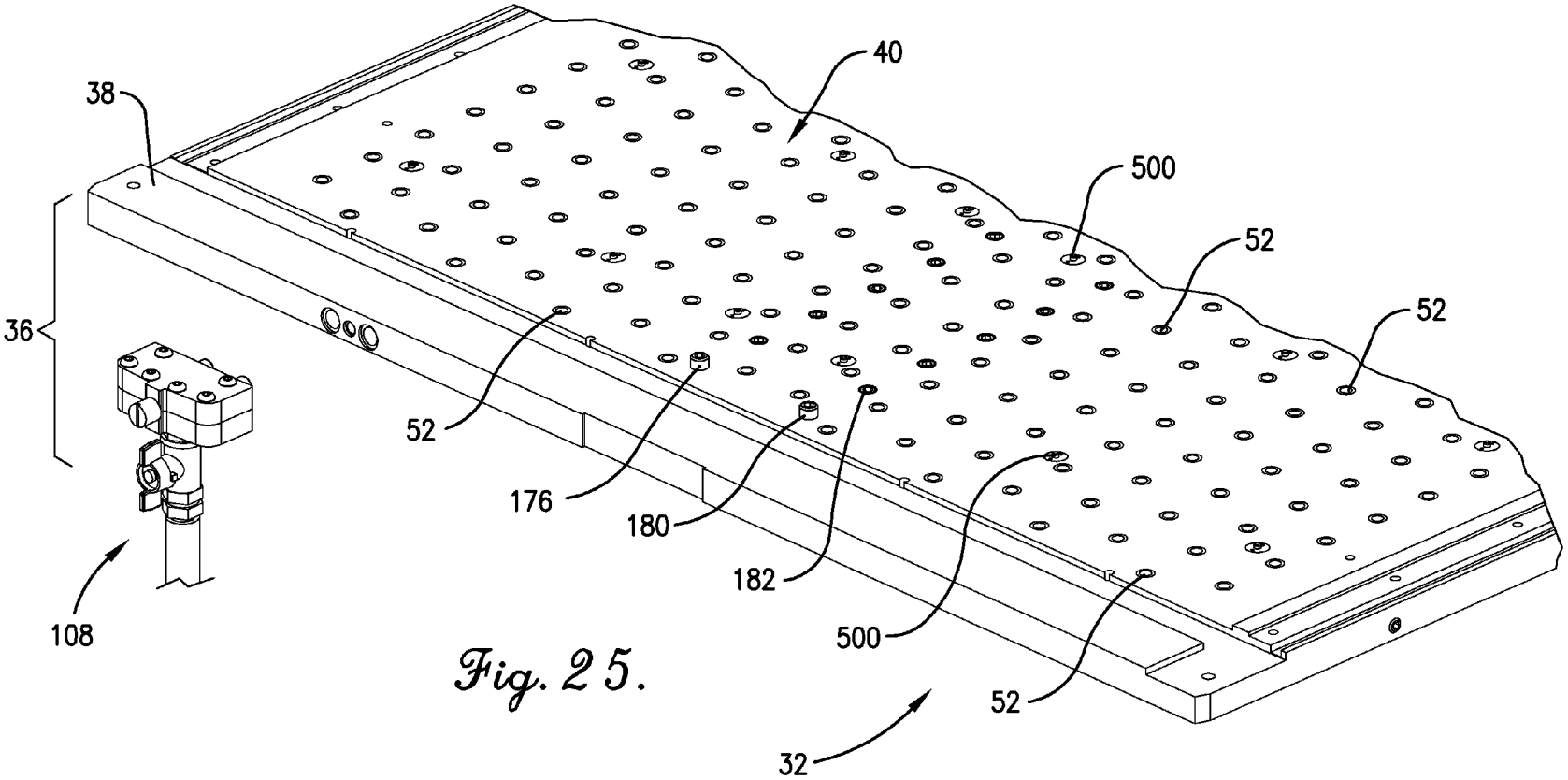
Figure 26:
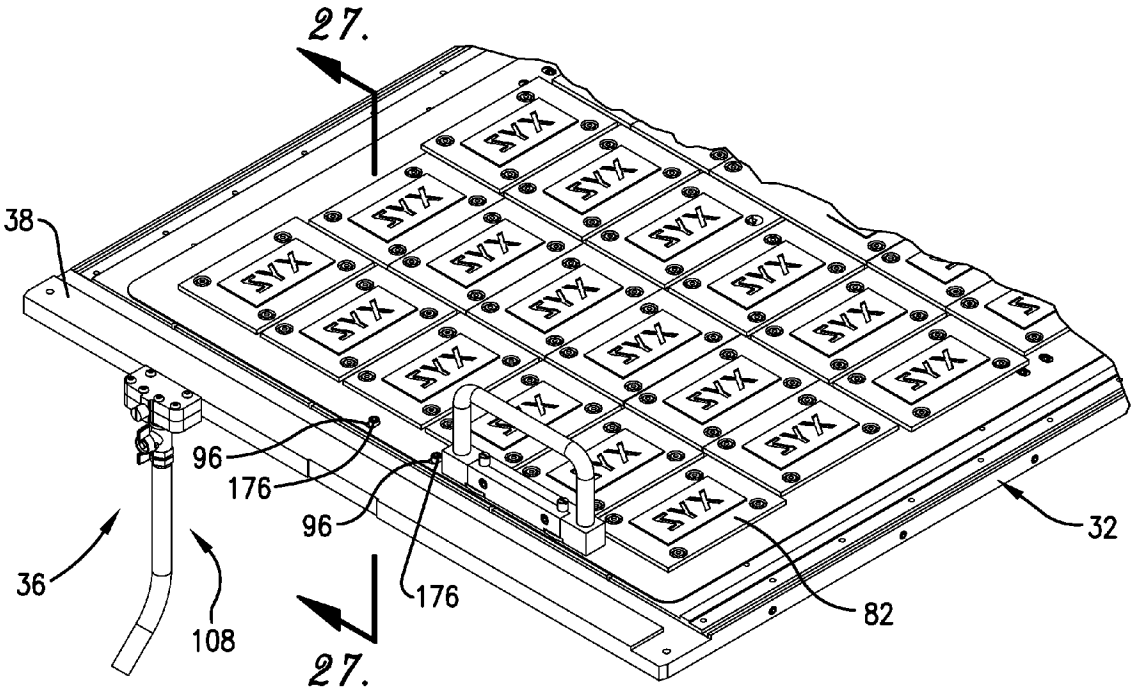
Figure 27:
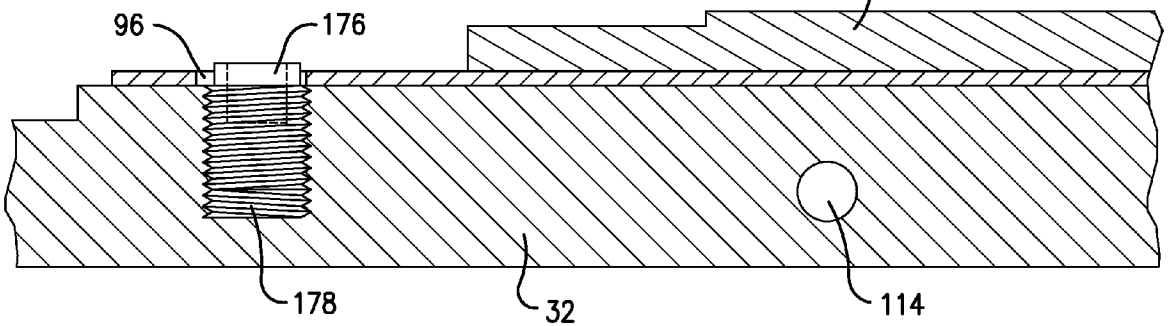

FIG. 11 is an enlarged, fragmentary, partial vertical sectional view of the graphic arts die supporting assembly, similar in many respects to the view of FIG. 7, depicting in detail an air-activated piston assembly received within a threaded hole of the chase and with the hole in communication with the manifold of air passageways, wherein the piston is shown disposed in a recessed position and the die plate is disposed on the engagement surface of the chase in magnetic securement thereto;

FIG. 12 is an enlarged, fragmentary, partial vertical sectional view of the graphic arts die supporting assembly of FIG. 11, but depicting the air-activated piston in an extended position upon flow of compressed air through the manifold and the die plate is disposed above the engagement surface of the chase;

FIG. 13 is an enlarged, fragmentary, partial vertical sectional view of the graphic arts die supporting assembly, similar in many respects to the view of FIG. 11, but depicting in detail an alternative air-activated multiple-tiered aligning and lifting piston assembly constructed in accordance with the principles of another embodiment of the present invention, with the assembly received within a threaded hole of the chase and with the hole in communication with the manifold of air passageways, wherein the aligning and lifting piston is shown disposed in a recessed position, such that the aligning tier projects above the engagement surface of the chase and is received in a corresponding alignment slot in the die plate but the lifting tier is recessed and the die plate is disposed on the engagement surface of the chase in magnetic securement thereto;

FIG. 14 is an enlarged, fragmentary, partial vertical sectional view of the graphic arts die supporting assembly of FIG. 13, but depicting the air-activated multiple-tiered aligning and lifting piston in an extended position upon flow of compressed air through the manifold, such that the lifting tier is extended and the die plate is disposed above the engagement surface of the chase;

FIG. 15 is an enlarged, fragmentary, partial vertical sectional view of the graphic arts die supporting assembly, similar in many respects to the view of FIG. 11, but depicting in detail an alternative air-activated aligning and lifting assembly constructed in accordance with the principles of another embodiment of the present invention, with a lifting piston and aligning pin component received within a threaded hole of the chase and with the hole in communication with the manifold of air passageways, wherein an inner aligning pin is shown disposed in a projecting position and is received in a corresponding alignment slot in the die plate, and an outer lifting piston is disposed in a recessed position with the die plate disposed on the engagement surface of the chase in magnetic securement thereto;

FIG. 16 is an enlarged, fragmentary, partial vertical sectional view of the graphic arts die supporting assembly of FIG. 15, but depicting the outer lifting piston of the air-activated aligning and lifting assembly shown disposed in an extended position upon flow of compressed air through the manifold, such that the die plate is disposed above the engagement surface of the chase;

FIG. 17 is an enlarged, fragmentary, partial vertical sectional view of the graphic arts die supporting assembly, similar in many respects to the view of FIG. 15, but depicting in detail the air-activated aligning and lifting assembly with the inner aligning pin shown disposed in a retracted position underneath the die plate, because the pin is not aligned with a plate opening, and with the outer lifting piston shown disposed in a recessed position with the die plate disposed on the engagement surface of the chase in magnetic securement thereto;

FIG. 18 is an enlarged, fragmentary, partial vertical sectional view of the graphic arts die supporting assembly of FIG. 17, but depicting the outer lifting piston of the air-activated aligning and lifting assembly shown disposed in an extended position upon flow of compressed air through the manifold, with the aligning pin still retracted, such that the die plate is disposed above the engagement surface of the chase;

FIG. 19 is an enlarged, fragmentary, partial vertical sectional view of an alternative graphic arts die supporting assembly constructed in accordance with the principles of another embodiment of the present invention, similar in many respects to the assembly shown in FIG. 11, but depicting a plurality of rotational cams mounted on shafts rotatably disposed within recesses of the chase, wherein the cams are in a disengaged position and the die plate is disposed on the engagement surface of the chase in magnetic securement thereto;

FIG. 20 is an enlarged, fragmentary, partial vertical sectional view of the alternative graphic arts die supporting assembly of FIG. 19, but depicting the plurality of cams in an engaged position, wherein the cams have been turned over center, and the die plate is disposed above the engagement surface of the chase;

FIG. 21 is an enlarged, fragmentary, partial vertical sectional view of an alternative graphic arts die supporting assembly constructed in accordance with the principles of another embodiment of the present invention, similar in many respects to the assembly shown in FIG. 11, but depicting a laterally moving cam element in a recessed position, wherein angled protrusions on the cam element are received in corresponding angled channels of the chase and the die plate is disposed on the engagement surface of the chase in magnetic securement thereto;

FIG. 22 is an enlarged, fragmentary, partial vertical sectional view of the alternative graphic arts die supporting assembly of FIG. 21, similar in many respects to the assembly shown in FIG. 12, but depicting the laterally moving cam element in an extended position, wherein the angled protrusions on the cam element are cooperating with the angled channels of the chase to shift the cam element upward and the die plate is disposed above the engagement surface of the chase;

FIG. 23 is an enlarged, fragmentary, perspective view of a graphic arts die supporting assembly, similar in many respects to the assembly shown in FIG. 1, but particularly illustrating a die plate, smaller than that of FIG. 1, with a pair of detachable handles and individual dies thereon;

FIG. 24 is a partially exploded perspective view of an alternative graphic arts die supporting assembly constructed in accordance with the principles of another embodiment of the present invention, similar in many respects to the assembly shown in FIG. 1, but depicting a plurality of threaded alignment pins threadably received within the chase;

FIG. 25 is an enlarged, fragmentary, perspective view of the graphic arts die supporting assembly shown in FIG. 24, particularly illustrating in detail a portion of the engagement surface of the chase, including magnet assemblies, threaded alignment pins, the plurality of pistons in an extended position, and the compressed air coupler with an associated inlet on the chase;

FIG. 26 is a fragmentary perspective view of the graphic arts die supporting assembly shown in FIG. 24, depicting the components thereof assembled together and similar in many respects to the assembly shown in FIG. 1, but including the alternative threaded alignment pins threadably received within the chase and projected through slotted alignment openings in the die plate; and FIG. 27 is an enlarged, fragmentary, vertical sectional view of the graphic arts die supporting assembly, taken along the line 27-27 of FIG. 26, particularly illustrating in detail a portion of the chase with a threaded alignment pin threadably received in an alignment pin receiving hole in the chase, and with a portion of the pin projecting upwardly therefrom and being received in a corresponding alignment slot in the die plate.

The drawing figures do not limit the present invention to the specific embodiments disclosed and described herein. The drawings are not necessarily to scale, emphasis instead being placed upon clearly illustrating the principles of the preferred embodiments.

DETAILED DESCRIPTION OF THE PREFERRED EMBODIMENTS

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments.

With initial reference to FIG. 1, a graphic arts die supporting assembly 30 selected for purposes of illustration generally includes a chase 32 and a die plate 34 disposed on top of the chase 32 and selectively secured thereto. The chase 32 includes a releasing assembly 36 for selectively disengaging the securement between the chase 32 and the die plate 34. The assembly 30 is generally configured and dimensioned to be inserted in and operate with a stamping, die cutting, or embossing station of a conventional sheet fed press, as will be readily appreciated by one of ordinary skill in the art.

Figure 2:
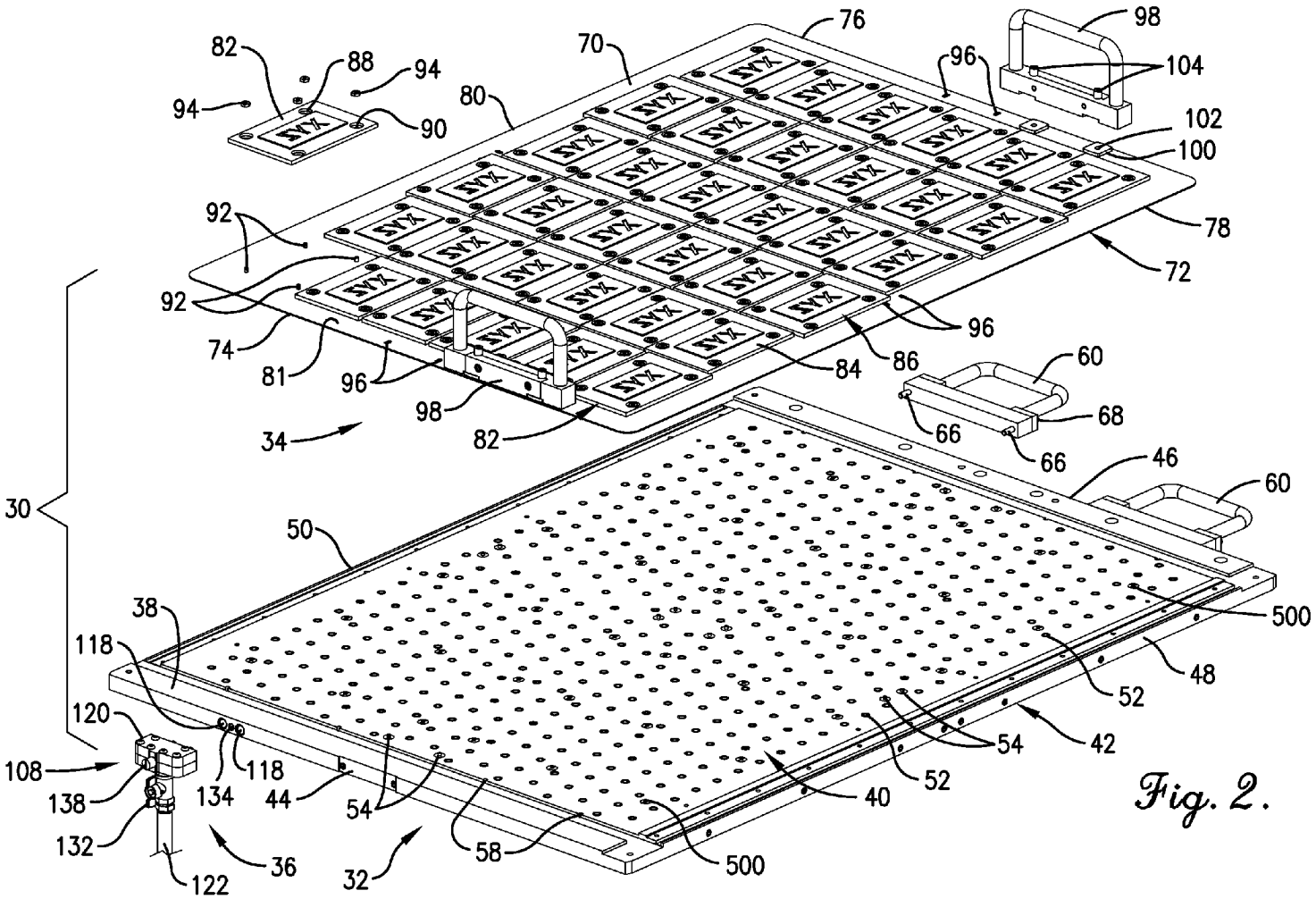
FIG. 2 is a partially exploded perspective view of the graphic arts die supporting assembly shown in FIG. 1, particularly illustrating separate components thereof, including the compressed air coupler, detachable handles, a chase having an engagement surface, and a die carrier plate with a plurality of individual dies thereon.

Referring to FIGS. 1 and 2, the chase 32 broadly comprises a body 38 including a top engagement surface 40 and an opposed bottom surface 42. The body 38 also presents a first pair of opposed side portions 44, 46 and a second pair of opposed side portions 48, 50, cooperating to define the outer margins of the body 38. As best shown in FIG. 2, the chase also includes a plurality of magnet assemblies 52 disposed along the engagement surface 40 of the body 38. The chase 32 further comprises a plurality of alignment pin assemblies 54, each assembly received within a hole 56 in the body 38 of the chase 32, and additional edge alignment pin receiving holes 58, all disposed along the engagement surface 40 of the body 38. Finally, the chase 32 includes a pair of handles 60, detachably secured to the side 46 of the body 38, to facilitate the insertion and removal of the assembly 30 from the stamping, die cutting, or embossing station of a conventional sheet fed press (not shown).

The body 38 of the chase 32 is appropriately configured and dimensioned for insertion into a desired press, with the illustrated embodiment depicting a body that is a typical forty inch by twenty-seven inch (40"×27") size, although it is clearly within the ambit of the present invention to provide a body with an alternate shape or size. It is noted that the body 38 of the chase 32 can be configured either as a replacement for a conventional apertured chase as illustrated or, alternatively, for use with a conventional apertured chase without departing from the teachings of the present invention. In the alternative case of the chase 32 being configured for use with a conventional apertured chase, the body 38 would be mounted within or on top of the conventional chase (provided that the total height is not significantly varied, so that the press does not require modification), as will be readily appreciated by one of ordinary skill in the art upon review of this disclosure.

The illustrated body 38, configured as a replacement for a conventional apertured chase, has a thickness defined between the top engagement surface 40 and the bottom surface 42 of approximately one half inch to one inch (½" to 1"). Alternatively, in the case of a body configured for use with a conventional apertured chase (not shown), the thickness would typically be between one eighth inch to one quarter inch (⅛" to ¼") to facilitate proper spacing within the press, as will be understood by one of ordinary skill in the art. Furthermore, the body 38 is preferably made of a nonferrous metal material, such as aluminum, although a ferrous material, such as steel, can be used with the magnet assemblies 52 properly arranged, as will be understood by one of ordinary skill in the art.

With further detail now regarding the configuration of the engagement surface 40 of the body 38, as illustrated particularly well in FIG. 2, it is noted that the magnet assemblies 52 are disposed in a generally staggered pattern generally consisting of about eighteen rows along the sides 44, 46 and about between twenty-six and twenty-seven rows along the sides 48, 50. Thus, the illustrated embodiment depicts a total of four hundred seventy-six magnet assemblies 52, although it will be readily appreciated by one of ordinary skill in the art that other suitable magnet assemblies may be provided with alternate shape, pole arrangement, pattern, or number without departing from the teachings of the present invention.

With attention briefly now to additional details of the magnet assemblies 52, it is noted that the assemblies are depicted as arranged on the engagement surface 40 of the body 38 in the enlarged illustration of FIG. 3. A single magnet assembly 52 is depicted in detail in the cross sectional view of FIG. 3*a*, and it will be readily appreciated by one of ordinary skill in the art that the details shown regarding the single magnet assembly 52 illustrated in FIG. 3*a* apply in like manner to each of the other depicted magnet assemblies 52 disposed along the engagement surface 40 of the body 38. Each magnet assembly 52 broadly includes a permanent magnet 162 disposed within a cup 164 and held in such disposition by epoxy 166. It is noted that while the illustrated embodiment depicts the magnet 162 being held in place with epoxy 166, the magnet 162 could alternatively be held in proper disposition within the cup 164 by a press fit arrangement or the use of other suitable adhesive or securement structure without departing from the teachings of the present invention. The approximate height of the magnet assembly 52 is preferably, although not necessarily, about the same as the thickness of the die plate 34.

The illustrated magnet 162 is in the shape of a disk with one flat side 168 being North and another flat side 170 being South, although it is noted that the orientation of the sides 168, 170 of the magnet 162 is immaterial for purposes of the magnet assembly 52 (e.g., the North side 168 could be up or down in the cup 164), as will be readily appreciated by one of ordinary skill in the art upon a review of this disclosure. It is specifically noted that within the magnet industry, the North and South sides 168, 170 may alternatively be referred to as positive (+) or negative (−) sides, as will be readily understood by one of ordinary skill in the art.

It is also noted that, because the illustrated assembly 30 has particularly advantageous utility for hot foil stamping operations, the magnets 162 of the magnet assemblies 52 are preferably, although not necessarily, fabricated of samarium-cobalt. This material effectively tolerates the high operating temperatures of these applications (in particular, normal hot foil stamping temperatures can often reach from about two hundred to three hundred degrees Fahrenheit (200-300° F.)) without demagnetizing.

The magnet 162 is disposed within the cup 164, such that the magnet assembly 52 can be used in the body 38 of the chase 32 or, alternatively, in another similar chase of different material or shape. The cup 164 is preferably, although not necessarily, made of mild steel. In the illustrated embodiment, the ferromagnetic nature of the mild steel of the cup 164 cooperates with the magnet 162 to direct a magnetic field 172 above the top of the magnet assembly 52. In the embodiment depicted in FIG. 3*a*, the cup 164 is generally shaped in the form of a cylinder with a recess 174 that generally corresponds to the shape of the magnet 162. The recess 174 presents a diameter dimension that is slightly larger than the diameter dimension of the magnet 162. The space along the sides of the recess 174, between the magnet 162 and the cup 164 is filled with the epoxy 166. The epoxy 166 maintains the magnet 162 in proper location within the cup 164 and is suitable for high temperature applications. It is noted that the epoxy 166 is limited to the space along the sides of the magnet 162, and specifically not underneath the magnet 162, to ensure optimum magnetic flux.

The preferred magnetic field 172 for the application of the present invention, and that generated by the construction of the magnet assembly 52 described above, is typically referred to in the magnetic industry as "magnetized through the thickness" or "magnetized parallel to the thickness." It is noted that this is the most common type of magnetic field for the disk shaped magnet 162, although it is also noted that there are several types of magnetic field orientations that could alternatively be used, as would be understood by one of ordinary skill in the art. The details of construction of the illustrated magnet assembly 52 described above result in a magnet assembly 52 that effectively directs the flux of the magnetic field 172 to the "target" of the ferromagnetic portion of the die plate 34. This direction of the magnetic flux results in an increase in the flux density and holding power of the magnet assembly 52 and concentrates the magnetic field 172 to the proper "work area" for the application of the present invention.

It is specifically noted that the work area does not extend much above the engagement surface 40 of the chase 32. Thus, the die plate 34 need not be lifted far above the chase 32 to facilitate easy movement and repositioning of the die plate 34. In the illustrated embodiment, the preferred extent of the work area is approximately one eighth inch (⅛") above the engagement surface 40, as will be readily appreciated by one of ordinary skill in the art upon review of this disclosure.

Thus, it is specifically noted that the magnetic field 172 generated by the magnet assemblies 52 of the chase 32 is such that a magnetic force is exerted upon a ferromagnetic object within the magnetic field 172. Of particular note with respect to the operation of the present invention, the die plate 34 is magnetically attracted to the chase 32 by this magnetic force any time the die plate 34 is within the area of the magnetic field 172 (schematically shown in broken lines in FIG. 3*a*). This attraction is strongest when the die plate 34 is flushly engaged against the engagement surface 40 of the body 38 of the chase 32. Therefore, as used herein, the term magnetic securement is used to mean that the die plate 34 and the chase 32 are contacting one another, such that the die plate 34 is flushly engaged against the chase 32, and the magnetic force is sufficiently strong so that relative lateral movement between the die plate 34 and the chase 32 is substantially restricted.

Next, it is noted that the alignment pin assemblies 54 are arranged on the chase 32 in a pattern approximately corresponding with three of the four corners of each of four quadrants of the engagement surface 40. This arrangement includes a total of twelve alignment pin assemblies 54 and matched holes 56. It is also noted with respect to the alignment pin assemblies 54 and matched holes 56, that the enlarged views of FIGS. 9 and 10 depict additional details of the alignment pin assemblies 54 and are described in greater detail below.

Turning briefly now to the alignment pin assemblies 54 as depicted in FIGS. 9 and 10, each alignment pin assembly 54 broadly includes a plug body 402, a reciprocating pin 404, and a spring 406. In addition, a manifold 106 of air passageways, described in more detail below, is in communication with a source of compressed air (not shown), at least one of the upwardly extending holes 56, and at least one air-released alignment pin assembly 54 received within the hole 56.

The plug body 402 is externally threaded to be secured within the internally threaded hole 56 and includes a plug top surface 408 that is substantially flush with the engagement surface 40 of the chase 32 when the plug body 402 is received within the hole 56. The plug body 402 includes an upper internal groove 410 that contains an upper seal member 412 and a lower internal groove 414 that receives a spring restricting snap ring 416. The plug body 402 further includes a stop surface 418 to confine allowable upward movement of the pin 404 and to cooperate with the pin 404 to define a pressure chamber 420.

The pin 404 generally includes an upper portion 422 and a lower portion 424, wherein the upper portion 422 further includes a die plate aligning portion 426 for cooperating with the die plate 34 to align the die plate 34 with respect to the chase 32. The pin 404 also includes a bump surface 428 for engaging the stop surface 418 of the plug body 402. The pin lower portion 424 further includes a releasing surface 430, an opposed spring engaging surface 432, and an internal groove 434 that contains a lower seal member 436, wherein the groove 434 is disposed between the releasing surface 430 and the spring engaging surface 432.

The upper and lower bounds of the pressure chamber 420 are defined by the stop surface 418 of the plug body 402 and the releasing surface 430 of the pin 404, respectively. It is noted that the plug body 402 also includes at least one air passage 438 therein such that compressed air (shown by arrows 440) is in communication between the pressure chamber 420 and the manifold 106 through the air passage 438. Furthermore, it is noted that the spring 406 is confined within the plug body 402 between the spring engaging surface 432 of the pin 404 and the spring restricting snap ring 416 of the plug body 402. Finally, the air-released pin assembly 54 also includes an air vent bleed hole 442 extending from the bottom of the hole 56 through the chase 32, such that excess compressed air can vent from the assembly 54 (shown by arrow 444).

In accordance with the structure recited above, the pin 404 of the depicted air-released pin assembly 54 moves between a retracted position (shown in FIG. 9) and a projecting position (shown in FIG. 10). When the pin 404 is in the retracted position, the die plate aligning portion 426 of the upper portion 422 is below the engagement surface 40 of the chase 32, and the die plate 34 can be disposed flushly against and magnetically secured to the chase 32 in any position, either properly aligned or otherwise. To move the pin 404 to the retracted position, the source of compressed air (not shown) is activated to flow compressed air through the manifold 106, through the air passage 438, and into the pressure chamber 420 of the assembly 54. Within the pressure chamber 420, the compressed air pushes against the stop surface 418 of the plug body 402 and against the releasing surface 430 of the pin 404 to move the pin 404 downward, compressing the spring 406 between the spring engaging surface 432 of the pin 404 and the spring restricting snap ring 416 of the plug body 402.

Conversely, to move the pin 404 to the projecting position, wherein a part of the pin 404, namely the die plate aligning portion 426 of the upper portion 422, extends above the engagement surface 40 of the chase 32, the source of compressed air is deactivated. Upon deactivation of the source of compressed air, the remaining compressed air within the manifold 106 is bled out of the system. In this condition, the spring 406 extends, pushing against the spring engaging surface 432 of the pin 404 and the spring restricting snap ring 416 of the plug body 402 to move the pin 404 upward until the bump surface 428 of the pin 404 contacts the stop surface 418 of the plug body 402 to restrict further upward movement of the pin 404.

When the pin 404 of a pin assembly 54 is in the projecting position, with the die plate aligning portion 426 of the upper portion 422 extending above the engagement surface 40 of the chase 32, the pin 404 can be used for proper aligned registration of the die plate 34 on the chase 32, as will be readily appreciated by one of ordinary skill in the art. If a particular alignment pin assembly 54 is not being used for alignment purposes, then the pin 404 of such an assembly can remain in the projecting position provided that it does not cause interference with the placement of the die plate 34. In the case of an alignment pin assembly 54 not being used for alignment purposes wherein the pin 404 in the projecting position is disposed at the same location that the die plate 34 is to be disposed, then the pin 404 can be shifted to the retracted position by the weight, and magnetic attraction, of the die plate 34 pushing down on the die plate aligning portion 426 of the upper portion 422 of the pin 404 and overcoming the force of the spring 406 when the die plate 34 is magnetically secured to the chase 32.

As will be appreciated by one of ordinary skill in the art upon review of this disclosure, the degree to which the die plate aligning portion 426 of the upper portion 422 of the pin 404 extends above the engagement surface 40 of the chase 32 is controlled by the selected dimension of the pin 404 and can be controlled by sizing the assembly 54 appropriately. Additionally, the degree of the force biasing the pin 404 toward the projecting position is determined by the parameters of the spring 406 used in the assembly 54, which can be appropriately selected for a given application.

Under normal operation, it is also noted that the projecting position of the assembly 54 shown in FIG. 10, as discussed above, is achieved by the extension force of the spring 406 and deactivation of the source of compressed air. Thus, the default for the air-released pin assembly 54 is to remain in the projecting position. In this way, the die plate aligning portion 426 of the upper portion 422 of the pin 404 is ordinarily available for an operator to use in aligning the die plate 34 in proper registration with respect to the chase 32. At such time as the plates are out of alignment and it is necessary to shift the die plate 34 relative to the chase 32, the source of compressed air can be activated to move the pin 404 from the projecting position to the retracted position, whereby the die plate 34 is free to move relative to the chase 32 in any direction.

It is noted that the provision of the specific projecting and retracted positions provide the alignment pin assemblies 54 with reliable performance, wherein the movement of the pin 404 is the same every time. Furthermore, additional advantages of the air-released pin assembly 54 include the replaceability of individual components or the assembly 54 as a whole. To this end, it is noted that the elements of the assembly 54 can be assembled as a self-contained unit, wherein the plug body 402 can thereafter be simply screwed into a threaded hole, such as hole 56, and tightened in place by the use of a spanner wrench and associated holes 446 extending downwardly from the top surface 408 of the plug body 402. Additionally, it is specifically noted that the air-released pin assembly 54 forms a substantially closed loop system. Such a substantially closed system may result in less noise and/or less mess than a substantially open system.

Returning now to FIGS. 1 and 2, and with respect to the additional edge alignment pin receiving holes 58, it is noted that four of these holes are approximately evenly spaced along each of the side margins of the engagement surface 40 that correspond to the sides 44, 46, 48, 50 of the body. As will be readily appreciated by one of ordinary skill in the art upon review of this disclosure, the number or pattern disposition of any of the alignment pin receiving holes 56, or additional edge alignment holes 58, may be modified to work with a corresponding alternative assembly (not shown), without departing from the teachings of the present invention.

With respect to the handles 60, it is noted that each handle 60 is detachably secured to the body 38 in a manner known in the art, such as by threading bolts 66 into holes disposed in the side 46 of the body 38 (not shown). In the illustrated embodiment, the handle securing bolts 66 are tightened by turning knobs 68 connected to the bolts 66 and protruding outwardly from the base of the handle 60. It is noted that it is within the ambit of the present invention to attach alternate handles to other sides of the body 38, to secure such handles using other known methods, or to provide a body with no handles at all.

With continued reference to FIGS. 1 and 2, the die plate 34 includes a top surface 70 and an opposed bottom surface 72. The plate 34 also presents a first pair of opposed side portions 74, 76 and a second pair of opposed side portions 78, 80, cooperating to define the outer margins of the plate 34. In the illustrated embodiment, the die plate 34 includes a die carrier plate 81 that is adapted to support a plurality of engraved dies 82 on the top surface 70 thereof. The die carrier plate 81 is made of a ferromagnetic material, such as steel, and presents length and width dimensions that are substantially the same as those of the engagement surface 40 of the chase 32, although such corresponding size is not necessary. Alternatively, the die carrier plate 81 could be made at least partly of a non-ferromagnetic material and include ferromagnetic sections or inserts therein. The ferromagnetic nature of the die carrier plate 81 provides for secure attachment to the engagement surface 40 of the chase 32 by the magnetic force of the magnet assemblies 52 within the chase 32 when the bottom surface 72 of the die carrier plate 81 and the engagement surface 40 of the chase 32 are in contacting disposition, as discussed in greater detail above.

As discussed briefly above, the die carrier plate 81 depicted herein is adapted to support a plurality of engraved dies 82 on the top surface 70 of the plate 81. Each of the dies 82 includes a die top surface 84 and an opposed die bottom surface 86, wherein the die top surface 84 includes an image to be used in the press operation and the die bottom surface 86 is configured for securement to the die carrier plate 81. Each die 82 also includes a recess 88 with a hole 90 therethrough disposed near each of the four corners of the die 82, although alternative hole dispositions are clearly within the ambit of the present invention.

A plurality of threaded studs 92 are located on the top surface 70 of the die carrier plate 81 and extend upwardly therefrom. As perhaps shown best in FIG. 2, each die 82 is disposed on the top surface 70 of the plate 81 such that the studs 92 align with and extend through the corresponding holes 90 in each die 82. A nut 94 is threaded over each stud 92 and is tightened so that the nut 94 is disposed within the recess 88 of the die 82. In this manner, each die 82 is securely affixed to the die carrier plate 81 with the die bottom surface 86 being flushly engaged with a portion of the top surface 70 of the plate 81.

Preferably, each of the threaded studs 92 is welded to the top surface 70 of the plate 81 by a CNC welding machine that has been programmed to register the locations of the studs 92 and the holes 90 in each die 82. The procedure for precise registration and positioning of the threaded studs 92 onto the plate 81 is described in detail in U.S. Pat. No. 7,096,709 ("the '709 patent"), hereby incorporated by reference in its entirety, to the extent not inconsistent with the present disclosure, and having the same assignee of record as the present application. The '709 patent also describes the manner in which the dies 82 can be located on the plate 81 in particular disposition such that respective dies precisely align with the artwork on a substrate to be die cut, hot foil stamped, or embossed, or with respect to specific areas of the substrate.

Additionally, it is noted that, alternatively, the dies 82 may be affixed to the plate 81 with screws (not shown) that extend through the plate 81 and project upwardly into the holes 90 of each die 82 for receipt of nuts, such the illustrated nuts 94. The procedure for precise registration and positioning of such alternative fastening screws is similarly detailed in the '709 patent, noted and incorporated by specific reference above.

Returning now to the structure of the die carrier plate 81 as shown in FIG. 2, the plate 81 also includes four pairs of aligning slots 96 extending therethrough from the top surface 70 to the bottom surface 72. As perhaps best shown in FIG. 1, when the die carrier plate 81 and the chase 32 are securely attached to one another by the magnetic force between the two, the die carrier plate 81 must be registered in proper position on the chase 32. Such disposition in proper registration can be accomplished by the receipt of one or more of the alignment pin assemblies 54 protruding from the chase 32 in the respective alignment slots 96 within the die carrier plate 81.

As discussed in more detail above with respect to the details of each of the alignment pin assemblies 54, and illustrated particularly well in the enlarged detail views of FIGS. 9 and 10, pin 404 can be shifted between projecting and retracted positions. In this way, the die plate aligning portion 426 of the upper portion 422 of the pin 404 in the projecting position corresponds with and is received in the slot 96 (as shown in FIG. 9). Other pin assemblies 54 that are not used for alignment purposes with a specific die carrier plate 81 are shifted to the retracted position by the weight, and magnetic attraction, of the die carrier plate 81 pushing the pins 404 downward and overcoming the biasing force of the springs 406, as described above. Thus, the bottom surface 72 of the die carrier plate 81 and the engagement surface 40 of the chase 32 flushly engage one another and are held in such magnetically secured position by magnetic force.

To facilitate movement of the die carrier plate 81 during the alignment process, the plate 81 includes a pair of handles 98, detachably secured to the top surface 70 of the plate 81 and similar in many respects to the handles 60 secured to the chase 32. It is noted that the two of the sides 74, 76 of the plate 81 each include a pair of protrusions 100 extending upwardly from the top surface 70 thereof. Each protrusion 100 includes a centrally located threaded hole 102 extending vertically from the top of the protrusion 100. Thus, each handle 98 is detachably secured to the plate 81 in a manner known in the art, such as by threading bolts (not shown) into the holes 102. In the illustrated embodiment, the handle securing bolts (not shown) are tightened by turning knobs 104 connected to the bolts (not shown) and protruding outwardly from the base of the handle 98. As with the handles 60 of the chase 32 described above, it is noted that it is within the ambit of the present invention to attach alternate handles to other locations of the plate 81, to secure such handles using other known methods, or to provide a die plate with no handles at all.

It is specifically noted that while the preferred embodiment illustrated herein depicts the die plate 34 being configured as a die carrier plate 81 with a plurality of individual dies 82 disposed thereon, it is clearly within the ambit of the present invention for an alternative die plate to simply comprise a die itself. One alternative includes a die wherein at least a portion of the die is formed from a ferromagnetic material, such as a bimetallic die. Examples of such a dies suitable for use as alternative die plates are disclosed in U.S. Pat. No. 6,341,557 ("the '557 patent") (directed to a graphic arts impression die assembly), and U.S. Pat. No. 6,584,893 ("the '893 patent") (directed to a graphic arts impression die). Both the '557 and the '893 patents are titled Non-Ferrous/Ferromagnetic Laminated Graphic Arts Impression Dies and Method of Producing the Same, and are hereby incorporated by reference in their entirety, to the extent not inconsistent with the present disclosure, and which both have the same assignee of record as the present application.

Turning now to additional details of the releasing assembly 36, it is noted that movement of the die plate 34 relative to the chase 32 during the alignment process can be difficult when the die plate 34 and the chase 32 are magnetically secured to one another. The securement force provided by the plurality of magnet assemblies 52 attracting the bottom surface 72 of the die plate 34 is considerable and is present whenever the die plate 34 and the chase 32 are in close contact (i.e., within the "work area"). As will be readily understood by one of ordinary skill in the art, the strength of this magnetic attraction is beneficial for securing the die plate 34 and the chase 32 together during a press operation, but can also make alignment difficult in the situation wherein the die plate 34 is magnetically secured to the chase in a disposition other than precise aligned registration.

With particular respect to the embodiment depicted in FIGS. 1-12, the releasing assembly 36 broadly includes a manifold 106 of air passageways in communication with a coupler of compressed air 108 and a plurality upwardly extending holes 110. It is specifically noted that the manifold 106 is also used to drive aligning assemblies, described in more detail below. The manifold 106 includes air passageways that extend longitudinally 112 and cross-wise 114 within the interior of the chase 32. As shown in FIG. 4, ends of the air passageways extending cross-wise 114 each terminate at a stop 116 disposed in the sides 48, 50 of the chase 32. Two of the air passageways extending longitudinally 112 communicate with a pair of air input ducts 118 disposed in the side 44 of the chase 32 and configured to selectively communicate with the coupler of compressed air 108.

It is specifically noted that while the illustrated embodiment and associated description herein references compressed air for driving the releasing assembly 36, it is clearly within the ambit of the present invention to use an alternative pressurized fluid in place of the compressed air. As will be readily appreciated by one of ordinary skill in the art, any or all references to compressed air and the driving force exerted thereby could alternatively take the form of other pressurized fluids, such as hydraulic fluid, without departing from the teachings of the present invention.

While the illustrated embodiment depicts a pair of input ducts 118, it is clearly within the ambit of the present invention to include more or fewer of such input ducts without departing from the teachings of the present invention. Additionally, it is specifically noted that the shape of the manifold 106, including the configuration, direction, and/or number of the air passageways, could be alternatively provided to suit the configuration of a given chase, as will be readily understood by one of ordinary skill in the art upon review of the present disclosure.

The coupler of compressed air 108 includes a body 120 with a hose 122 having one end in communication with the body 120 and another end in communication with a tank or other source (not shown). The body 120 includes an upper portion 124 and a lower portion 126, the portions connected with a plurality of screws 128. The body 120 further includes a pair of air outlets 130 extending outwardly from the body 120, configured for engagement with the air input ducts 118 of the manifold 106, and in communication with the air flowing from the hose 122. A control knob 132 is disposed at the connection between the body 120 and the hose 122 for selectively actuating and controlling the amount of flow of compressed air from the hose 122 through the air outlets 130, as will be understood by one of ordinary skill in the art.

As described briefly above, the coupler of compressed air 108 is configured for selective attachment to the chase 32 such that the air outlets 130 engage and communicate with the air input ducts 118 of the manifold 106. As shown in FIG. 3, a threaded hole 134 is disposed in the side 44 of the chase 32, located between the pair of air input ducts 118. The body 120 of the coupler of compressed air 108 includes an attachment screw 136 extending through the body 120 and disposed between and generally aligned with the pair of air outlets 130. An attachment knob 138 is connected to the attachment screws 136 and protrudes from the end of the body 120 such that the coupler of compressed air 108 can be selectively attached to the side 44 of the chase by inserting the attachment screw 136 into the hole 134 and tightening the attachment knob 138 in a manner known in the art.

With specific reference now to FIGS. 11 and 12, one embodiment of the releasing assembly 36 will be described in greater detail. The releasing assembly 36 broadly includes the manifold 106 of air passageways in communication with a source of compressed air (not shown), at least one threaded upwardly extending hole 110, and at least one air-activated piston assembly 500 received within the hole 110. The air-activated piston assembly 500 generally includes a plug body 502, a piston 504, and a spring 506.

The plug body 502 is externally threaded to be secured within the internally threaded hole 110 and includes a plug top surface 508 that is substantially flush with the engagement surface 40 of the chase 32 when the plug body 502 is received within the hole 110. The plug body 502 includes an internal groove 510 that receives a piston restricting snap ring 512. The plug body 502 further includes a spring engaging surface 514 that also includes a stop surface notch 516 to confine allowable upward movement of the piston 504.

The piston 504 generally includes an upper portion 518 and a lower portion 520, wherein the upper portion 518 further includes a top engagement surface 522 for engaging the bottom surface 72 of the die plate 34 and a bump surface 524 for engaging the stop surface notch 516 of the plug body 502. The piston lower portion 520 further includes a spring engagement surface 526, an opposed activating surface 528, and an internal groove 530 that contains a seal member 532, wherein the groove 530 is disposed between the spring engagement surface 526 and the activating surface 528. The activating surface 528 of the piston 504 cooperates with a bottom surface 534 of the hole 110 to define a pressure chamber 536.

The upper and lower bounds of the pressure chamber 536 are defined by the activating surface 528 of the piston 504 and the bottom surface 534 of the hole 110, respectively. It is noted that the plug body 502 also includes space between an outer periphery thereof 538 and a side 540 of the hole 110 to create at least one air passage 542 such that compressed air (shown by arrows 544) is in communication between the pressure chamber 536 and the manifold 106 through the air passage 542. Furthermore, it is noted that the spring 506 is confined within the plug body 502 between the spring engaging surface 514 of the plug body 502 and the spring engagement surface 526 of the piston 504.

In accordance with the structure recited above, the piston 504 of the depicted air-activated piston assembly 500 moves between a recessed position (shown in FIG. 11) and an extended position (shown in FIG. 12). When the piston 504 is in the recessed position, the top engagement surface 522 of the piston 504 is below the engagement surface 40 of the chase 32 and the die plate 34 can be disposed flushly against and magnetically secured to the chase 32. To move the piston 504 to the recessed position, the source of compressed air (not shown) remains deactivated, such that the spring 506 extends and pushes against the spring engaging surface 514 of the plug body 502 and the spring engagement surface 526 of the piston 504. This spring force moves the piston 504 downward until the activating surface 528 of the piston 504 contacts the piston restricting snap ring 512 to restrict further downward movement of the piston 504.

Conversely, to move the piston 504 to the extended position, wherein the top engagement surface 522 of the piston 504 extends above the engagement surface 40 of the chase 32 so that a disengagement force is exerted against the bottom surface 72 of the die plate 34, the source of compressed air is activated. The activation of the source of compressed air forces compressed air to flow through the manifold 106, through the air passage 542, and into the pressure chamber 536 of the assembly 500. Within the pressure chamber 536, the compressed air pushed against the bottom surface 534 of the hole 110 and against the activating surface 528 of the piston 504 to move the piston 504 upward, compressing the spring 506 between the spring engaging surface 514 of the plug body 502 and the spring engagement surface 526 of the piston 504.

The disengagement force applied to the die plate 34 by the top engagement surface 522 of the piston 504 is sufficient to disengage the magnetic securement between the die plate 34 and the chase 32. As will be appreciated by one of ordinary skill in the art upon review of this disclosure, the degree to which the die plate 34 is lifted above the chase 32 is controlled by the selected dimension of the piston 504 and can be controlled by sizing the assembly 500 appropriately. Additionally, the degree of the applied disengagement force is determined by the parameters of the spring 506 used in the assembly 500 relative to the amount of pressure exerted by the compressed air, both of which can be appropriately selected and/or adjusted for a particular application, depending on what is needed to overcome the strength of the magnetic field along the work area, as described in more detail above.

It is also noted that the extended position of the assembly 500 shown in FIG. 12, as discussed above, is achieved by the activation of the source of compressed air. Thus, the default for the air-activated piston assembly 500 is to remain in the recessed position, biased toward such position by the force of the spring 506, until the source of compressed air is activated. In this way, the die plate 34 will "float" above the chase 32 so that it can be shifted relative thereto upon the prescribed condition of activating the source of compressed air to allow for the alignment of the plates. At such time as the plates are properly aligned, the source of compressed air can be deactivated to move the piston 504 from the extended position to the recessed position, whereby the die plate 34 is again magnetically secured to the chase 32.

It is noted that the air-activated piston assembly 500 and the air-released alignment pin assembly 54 are depicted in the illustrated embodiment working together. As will be readily understood by one of ordinary skill in the art upon review of this disclosure, in this way, during the absence of association with the source of compressed air, the alignment pins 404 are up in the projecting position and the pistons 504 are down in the recessed position. In this arrangement, the die plate 34 can be magnetically secured to the chase 32 in aligned registration and can be used in press operations without need for association with a source of compressed air. On the other hand, if the die plate 34 is to be easily moved with respect to the chase 32, then upon association and activation of the source of compressed air, the alignment pins 404 move down to the retracted position and the pistons 504 move up to the extended position. In this arrangement, the die plate aligning portion 426 of the upper portion 422 of the pin 404 does not interfere with movement of the die plate 34, as the die plate 34 floats on top of the top engagement surface 522 of the piston 504.

It is further noted that the provision of the specific disengagement and engagement positions provide the releasing assembly 500 with reliable performance, wherein the movement translated to the die plate 34 is the same every time. It is also specifically noted that it is within the ambit of the present invention to incorporate the construction of the assembly 500 described above into an existing alternative releasing assembly, such as a releasing assembly that uses only the force of flowing compressed air to float a die plate above a chase, such that retrofitting of a chase is possible.

Furthermore, additional advantages of the mechanical air-activated piston assembly 500 include the replaceability of individual components or the assembly 500 as a whole. To this end, it is noted that the elements of the assembly 500 can be assembled as a self-contained unit, wherein the plug body 502 can thereafter be simply screwed into a threaded hole, such as hole 110, and tightened in place by the use of a spanner wrench and associated holes 546 extending downwardly from the top surface 508 of the plug body 502. Additionally, it is specifically noted that the air-activated piston assembly 500 forms a substantially closed loop system within the chase 32. Such a substantially closed system may result in less noise and/or less mess than a substantially open system. Moreover, because the same degree of the applied disengagement force can be consistently applied by each assembly 500, such a releasing assembly may be particularly effective for a system where the die plate may not be substantially the same size as the engagement surface of the chase. Finally, it is contemplated to fabricate at least the top engagement surface 522 of the piston 504 from a low friction material such that frictional drag is reduced when shifting the die plate 34 relative to the chase 32 along the top of the piston 504.

The manifold 106 is in communication with the plurality of upwardly extending holes 56 (with matched air-released alignment pin assemblies 54) and also with the plurality of upwardly extending holes 110 (with matched air-activated piston assemblies 500), as described above. Each of the holes 56, 110 extends upwardly from the air passageways 112, 114 of the manifold 106 to the engagement surface 40 of the body 38 of the chase 32, with the air-released alignment pin assemblies 54 and the air-activated piston assemblies 500 respectively received therein. In the embodiment depicted in FIGS. 1-12, the holes 110 are disposed on the engagement surface 40 in a pattern of six holes by six holes, for a total of thirty-six holes 110 (with matched air-activated piston assemblies 500) approximately evenly spaced along the engagement surface 40. As will be readily appreciated, such number or pattern of air holes is by way of example only and alternate configurations are within the ambit of the present invention.

When the coupler of compressed air 108 is secured to the side 44 of the chase 32 and the control knob 132 is turned to actuate the flow of compressed air from the tank (not shown), compressed air flows through the hose 122, out of the air outlets 130 of the body 120, into the air input ducts 118 of the manifold 106. The compressed air is then forced through the holes 56, 110 to shift the alignment pins 404 to a retracted position and to shift the pistons 504 to an extended position, as described in more detail above.

As will be appreciated by one of ordinary skill in the art upon review of this disclosure, the amount of compressed air is controlled by the knob 132 so that the disengagement force exerted by the flow of air pushing against the activating surface 528 of the piston 504 is sufficient to cause the piston 504 to move to an extended position to release the magnetic securement between the chase 32 and the die plate 34. So long as the compressed air is flowing through the holes 110 and exerting the force against the activating surface 528 of the piston 504, the bottom surface 72 of the die plate 34, the die plate 34 floats above the chase 34, as illustrated in FIG. 12.

It is further noted that additional advantages are presented by having compressed air flowing through the manifold 106 in the chase 32. The flow of compressed air through the manifold 106 cools the chase 32 and the die plate 34, which makes the die plate 34 easier to handle by an operator in the typical high temperature environment of many press operations. Accordingly, it is clearly within the ambit of the present invention to provide a manifold with a dense array of approximately evenly spaced passageways to increase the surface area or volume of cooling air that flows through the chase 32, even if some of such passageways are not directly associated with a hole 56, 110.

The method of moving the die plate 34 relative to the magnetic chase 32 should be apparent from the foregoing description and, therefore, will be described here only briefly. In keeping with the embodiment and component parts described above, it is assumed that the die plate 34 is magnetically secured to the engagement surface 40 of the magnetic chase 32. The coupler of compressed air 108 is associated with the body 38 of the chase 32 so that compressed air flows through the manifold 106 to shift the alignment pins 404 down to the retracted position and actuate the pistons 504 up to the extended position. In this arrangement, the die plate aligning portion 426 of the upper portion 422 of the pin 404 does not interfere with movement of the die plate 34, as the die plate 34 floats on top of the top engagement surface 522 of the piston 504. The disengagement force provided by the actuated pistons 504 causes the die plate 34 to float above the chase 32 such that the die plate 34 and the chase 32 are maintained in a sufficiently magnetically disengaged condition to facilitate virtually effortless movement (including repositioning) of the die plate 34 relative to the magnetic chase 32.

In a preferred embodiment, the handles 98 are secured to the die plate 34, as described above, to facilitate movement of the die plate 34. Additionally, movement of the die plate 34 relative to the chase 32 on the top engagement surfaces 522 of the pistons 504, is used to shift the sides 74, 76, 78, 80 of the die plate 34 into proper alignment with respect to the sides 44, 46, 48, 50 of the chase 32 such that alignment pin assemblies 54 in the chase 32 are in proper registration with alignment slots 96 in the die plate 34. After such shifting, the coupler of compressed air 108 is deactivated so that the air bleeds out, the pistons 504 return to a recessed position, and the alignment pins 404 return to projecting position, so that the die plate 34 and the chase are magnetically secured in proper registration, with the die plate aligning portion 426 of the upper portion 422 of the pin 404 of the alignment pin assemblies 54 received in the alignment slots 96.

With attention now to FIGS. 13-18, additional embodiments are disclosed for alternative air-activated piston assemblies that perform both aligning and lifting functions. It is noted initially, for the sake of clarity, that the additional embodiments of alternative air-activated piston assemblies described here are similar in many respects to the air-activated piston assembly 500 described above, particularly as shown in FIGS. 11 and 12, as will be readily understood by one of ordinary skill in the art upon review of this disclosure. In fact, it is specifically noted that these alternative air-activated piston assemblies can be used with the chase 32 (including the manifold 106 and the hole 110) and the die plate 34 of the assembly 30, and such use is illustrated in FIGS. 13-18.

Turning specifically now to FIGS. 13 and 14, one embodiment of an alternative air-activated piston assembly will be described in greater detail. It is noted that the manifold 106 of air passageways is in communication with a source of compressed air (not shown) and at least one threaded upwardly extending hole 110. It is further noted that the manifold 106 is also in communication with at least one air-activated aligning and lifting piston assembly 600 received within the hole 110. The air-activated aligning and lifting piston assembly 600 generally includes a plug body 602, a piston 604, and a spring 606. It is noted that the spring 606 is a wave spring, which can compress smaller than an extension spring under the same amount of force and thereby take up less space within the assembly, although such spring selection is depicted by way of example only.

The plug body 602 is externally threaded to be secured within the internally threaded hole 110 and includes a plug top surface 608 that is substantially flush with the engagement surface 40 of the chase 32 when the plug body 602 is received within the hole 110. The plug body 602 includes a spring engaging surface 610 that also includes a stop surface notch 612 to confine allowable upward movement of the piston 604.

The piston 604 generally includes an aligning portion 614 and a lifting portion 616, wherein the aligning portion 614 includes a die plate aligning surface 618 for cooperating with the die plate 34 to align the die plate 34 with respect to the chase 32. The aligning portion 614, including the die plate aligning surface 618, extends above the engagement surface 40 of the chase 32, such that the aligning portion 614 of the piston 604 can be used for proper registration of the die plate 34 on the chase 32. Such alignment is accomplished by the interaction of the die plate aligning surface 618 and the alignment slot 96 in the die plate 34, as will be readily appreciated by one of ordinary skill in the art.

The lifting portion 616 includes a die plate engagement shoulder 620 for engaging the bottom surface 72 of the die plate 34 and a bump surface 622 for engaging the stop surface notch 612 of the plug body 602. The piston 604 further includes a spring engagement surface 624 and an opposed activating surface 626. The activating surface 626 of the piston 604 cooperates with a bottom surface 628 of the hole 110 to define a pressure chamber 630.

The upper and lower bounds of the pressure chamber 630 are defined by the activating surface 626 of the piston 604 and the bottom surface 628 of the hole 110, respectively. It is noted that the plug body 602 also includes space between an outer periphery thereof 632 and a side 634 of the hole 110 to create at least one air passage 636 such that compressed air (shown by arrows 638) is in communication between the pressure chamber 630 and the manifold 106 through the air passage 636. Furthermore, it is noted that the spring 606 is confined within the plug body 602 between the spring engaging surface 610 of the plug body 602 and the spring engagement surface 624 of the piston 604.

In accordance with the structure recited above, the piston 604 of the depicted air-activated aligning and lifting piston assembly 600 moves between a recessed position (shown in FIG. 13) and an extended position (shown in FIG. 14). It is specifically noted that the aligning portion 614 of the piston 604, and in particular the die plate aligning surface 618, extends above the engagement surface 40 of the chase 32 in both the recessed and extended positions.

When the piston 604 is in the recessed position, the die plate engagement shoulder 620 of the piston 604 is below the engagement surface 40 of the chase 32 and the die plate 34 can be disposed flushly against and magnetically secured to the chase 32. To move the piston 604 to the recessed position, the source of compressed air (not shown) remains deactivated, such that the spring 606 extends and pushes against the spring engaging surface 610 of the plug body 602 and the spring engagement surface 624 of the piston 604. This spring force moves the piston 604 downward until a bottom surface 640 of the piston 604 contacts the bottom surface 628 of the hole 110 to restrict further downward movement of the piston 604.

Conversely, to move the piston 604 to the extended position, wherein the die plate engagement shoulder 620 of the piston 604 extends above the engagement surface 40 of the chase 32 so that a disengagement force is exerted against the bottom surface 72 of the die plate 34, the source of compressed air is activated. The activation of the source of compressed air forces compressed air to flow through the manifold 106, through the air passage 636, and into the pressure chamber 630 of the assembly 600. Within the pressure chamber 630, the compressed air pushed against the bottom surface 628 of the hole 110 and against the activating surface 626 of the piston 604 to move the piston 604 upward, compressing the spring 606 between the spring engaging surface 610 of the plug body 602 and the spring engagement surface 624 of the piston 604.

The disengagement force applied to the die plate 34 by the die plate engagement shoulder 620 of the piston 604 is sufficient to disengage the magnetic securement between the die plate 34 and the chase 32. As will be appreciated by one of ordinary skill in the art upon review of this disclosure, the degree to which the die plate 34 is lifted above the chase 32 is controlled by the selected dimension of the piston 604 and can be controlled by sizing the assembly 600 appropriately. Additionally, the degree of the applied disengagement force is determined by the parameters of the spring 606 used in the assembly 600 relative to the amount of pressure exerted by the compressed air, both of which can be appropriately selected and/or adjusted for a particular application.

It is noted that in the embodiment as depicted in FIGS. 13 and 14, particularly as opposed to the air-activated piston assembly 500 described above, that the aligning portion 614 of the piston 604 always extends above the engagement surface 40 of the chase 32. Thus, as will be readily understood by one of ordinary skill in the art upon review of this disclosure, even in the absence of association with the source of compressed air, the aligning portion 614 remains in a projecting position to facilitate proper registration. It will be further understood that the constant projection of the aligning portion 614 of this embodiment does require that a corresponding alignment slot 96 in the die plate 34 be available in order to have the die plate 34 disposed flushly against and magnetically secured to the chase 32.

Other advantages to this embodiment, similar to those described above, remain present, particularly the replaceability of individual components or the assembly 600 as a whole. To this end, it is noted that the elements of the assembly 600 can be assembled as a self-contained unit, wherein the plug body 602 can thereafter be simply screwed into a threaded hole, such as hole 110, and tightened in place by the use of a spanner wrench and associated holes 642 extending downwardly from the top surface 608 of the plug body 602.

Additionally, it is specifically noted that the air-activated aligning and lifting piston assembly 600 forms a substantially closed loop system within the chase 32. Such a substantially closed system may result in less noise and/or less mess than a substantially open system. Moreover, because the same degree of the applied disengagement force can be consistently applied by each assembly 600, such a aligning and lifting assembly may be particularly effective for a system where the die plate may not be substantially the same size as the engagement surface of the chase.

Next, with attention to FIGS. 15-18, an additional embodiment of an alternative air-activated piston assembly will be described in greater detail. It is noted that the manifold 106 of air passageways is in communication with a source of compressed air (not shown) and at least one threaded upwardly extending hole 110. It is further noted that the manifold 106 is also in communication with at least one air-activated aligning and lifting assembly 700 received within the hole 110. The air-activated aligning and lifting assembly 700 comprises a lifting piston and aligning pin pair that generally includes a plug body 702, a lifting piston 704 with a piston spring 706, and an aligning pin 708 with a pin spring 710. It is noted that both the piston spring 706 and the pin spring 710 are depicted as wave springs, which can compress smaller than extension springs under the same amount of force and thereby take up less space within the assembly, although such spring selection is depicted by way of example only.

The plug body 702 is externally threaded to be secured within the internally threaded hole 110 and includes a plug top surface 712 that is substantially flush with the engagement surface 40 of the chase 32 when the plug body 702 is received within the hole 110. The plug body 702 includes a piston spring engaging surface 714 that also includes a stop surface notch 716 to confine allowable upward movement of the piston 704.

The piston 704 generally comprises a hollow body 718 that defines a cavity 720 therein. The piston body 718 includes an upper portion 722 and a lower portion 724, wherein the upper portion 722 further includes a top engagement surface 726 for engaging the bottom surface 72 of the die plate 34 and a bump surface 728 for engaging the stop surface notch 716 of the plug body 702. The piston lower portion 724 further includes a piston spring engagement surface 730 and an opposed activating surface 732. The piston lower portion also presents a central hole 734 defined in the activating surface 732. The central hole 734, in communication with the cavity 720, is internally threaded and receives an externally threaded set screw 736 therein to close the cavity 720. The set screw 736 includes a non-circular recess 738 therein to facilitate the insertion and removal of the set screw 736 from the central hole 734, as will be appreciated by one of ordinary skill in the art. The activating surface 732 of the piston body 718 cooperates with a bottom surface 740 of the hole 110 to define a pressure chamber 742.

The upper and lower bounds of the pressure chamber 742 are defined by the activating surface 732 of the piston 704 and the bottom surface 740 of the hole 110, respectively. It is noted that the plug body 702 also includes space between an outer periphery thereof 744 and a side 746 of the hole 110 to create at least one air passage 748 such that compressed air (shown by arrows 750) is in communication between the pressure chamber 742 and the manifold 106 through the air passage 748. Furthermore, it is noted that the piston spring 706 is confined within the plug body 702 between the piston spring engaging surface 714 of the plug body 702 and the piston spring engagement surface 730 of the piston 704.

The aligning pin 708 and the pin spring 710 are disposed within the cavity 720 of the hollow piston body 718. The aligning pin 708 generally comprises a pin upper portion 752 and a pin lower portion 754, wherein the pin upper portion 752 further includes a die plate aligning surface 756 for cooperating with the die plate 34 to align the die plate 34 with respect to the chase 32. The aligning pin 708 also includes a bump surface 758 for engaging a pin stop surface 760 on the hollow piston body 718 disposed within the cavity 720. The pin lower portion 754 further includes a pin spring engaging surface 762 along a bottom side thereof.

The pin spring 710 is disposed between the pin spring engaging surface 762 of the pin 708 and an opposed pin spring engaging surface 764 of the set screw 736. The pin spring 710 biases the aligning pin 708 toward a projecting position (shown in FIGS. 15 and 16), wherein the die plate aligning surface 756 of the pin 708 extends above the engagement surface 40 of the chase 32, such that the aligning pin 708 can be used for proper registration of the die plate 34 on the chase 32. Such alignment is accomplished by the interaction of the die plate aligning surface 756 and the alignment slot 96 in the die plate 34, as will be readily appreciated by one of ordinary skill in the art.

It will also be readily appreciated that in the case of the pin 708 not being used for alignment purposes, such as when the pin 708 is disposed at the same location that the die plate 34 is to be disposed without the presence of an alignment slot 96, then the pin 708 can be shifted to the retracted position (shown in FIGS. 17 and 18). The shifting in the disposition of the pin 708 to the retracted position is accomplished by the weight of the die plate 34, and magnetic attraction between plates 32 and 34, pushing down on the die plate aligning surface 756 of the pin 708 and overcoming the force of the pin spring 710 when the die plate 34 is disposed against the pin 708 without the presence of an alignment slot 96. It is particularly noted that such displacement of the pin 708 is accomplished not only when the die plate 34 is magnetically secured to the chase 32 (shown in FIG. 17), but also when the die plate 34 is lifted and supported by the bottom surface 72 of the die plate 34 resting on the top engagement surface 726 of the piston 704 (shown in FIG. 18).

In accordance with the structure recited above, the piston 704 of the depicted air-activated aligning and lifting assembly 700 moves between a recessed position (shown in FIGS. 15 and 17) and an extended position (shown in FIGS. 16 and 18). When the piston 704 is in the recessed position, the top engagement surface 726 of the piston 704 is below the engagement surface 40 of the chase 32 and the die plate 34 can be disposed flushly against and magnetically secured to the chase 32. To move the piston 704 to the recessed position, the source of compressed air (not shown) remains deactivated, such that the piston spring 706 extends and pushes against the piston spring engaging surface 714 of the plug body 702 and the piston spring engagement surface 730 of the piston 704. This spring force moves the piston 704 downward until a bottom surface 766 of the piston 704 contacts the bottom surface 740 of the hole 110 to restrict further downward movement of the piston 704.

Conversely, to move the piston 704 to the extended position, wherein the top engagement surface 726 of the piston 704 extends above the engagement surface 40 of the chase 32 so that a disengagement force is exerted against the bottom surface 72 of the die plate 34, the source of compressed air is activated. The activation of the source of compressed air forces compressed air to flow through the manifold 106, through the air passage 748, and into the pressure chamber 742 of the assembly 700. Within the pressure chamber 742, the compressed air pushed against the bottom surface 740 of the hole 110 and against the activating surface 732 of the piston 704 to move the piston 704 upward, compressing the piston spring 706 between the piston spring engaging surface 714 of the plug body 702 and the piston spring engagement surface 730 of the piston 704.

The disengagement force applied to the die plate 34 by the top engagement surface 726 of the piston 704 is sufficient to disengage the magnetic securement between the die plate 34 and the chase 32. As will be appreciated by one of ordinary skill in the art upon review of this disclosure, the degree to which the die plate 34 is lifted above the chase 32 is controlled by the selected dimension of the piston 704 and can be controlled by sizing the assembly 700 appropriately. Additionally, the degree of the applied disengagement force is determined by the parameters of the piston spring 706 used in the assembly 700 relative to the amount of pressure exerted by the compressed air, both of which can be appropriately selected and/or adjusted for a particular application.

It is noted that in the embodiment depicted in FIGS. 15-18, particularly with reference to the air-activated piston assembly 500 described above, that the air-activated aligning and lifting assembly 700 achieves many similar advantages as the piston assembly 500 when used in combination with the alignment pin assemblies 54 described above. It is further noted, however, that the assembly 700 provides the additional benefit of a single assembly that can be received within any of the holes (such as holes 56 or 110) in the chase 32.

Other advantages to this embodiment, similar to those described above, remain present, particularly the replaceability of individual components or the assembly 700 as a whole. To this end, it is noted that the elements of the assembly 700 can be assembled as a self-contained unit, wherein the plug body 702 can thereafter be simply screwed into a threaded hole, such as hole 56 or hole 110, and tightened in place by the use of a spanner wrench and associated holes 768 extending downwardly from the top surface 712 of the plug body 702.

Additionally, it is specifically noted that the air-activated aligning and lifting piston assembly 700 forms a substantially closed loop system within the chase 32. Such a substantially closed system may result in less noise and/or less mess than a substantially open system. Moreover, because the same degree of the applied disengagement force can be consistently applied by each assembly 700, such a aligning and lifting assembly may be particularly effective for a system where the die plate may not be substantially the same size as the engagement surface of the chase.

Turning now to FIGS. 19-27, various additional embodiments are disclosed for alternative releasing assemblies provided by the present invention. It is noted that several of these embodiments utilize different mechanical components to actuate and provide a disengagement force between a chase and a die plate. Such mechanical actuation of a disengagement force provides several advantages in the industry, such as consistent, quiet, and reliable operation of the releasing assembly. Additionally, mechanical actuation makes the task of using a single releasing assembly to exert a disengagement force against a variety of sizes and/or types of die plates relatively simple, while providing consistently positive results.

With reference now to FIGS. 19 and 20, an additional embodiment of a graphic arts die supporting assembly 230 is depicted, generally including a similar chase 232 and a similar die plate 234 including a die carrier plate 235 supporting dies 282. The chase 232 and the die plate 234 are selectively secured to one another by a magnetic attraction, causing contact between an engagement surface 240 of the chase 232 and a bottom surface 272 of the die plate 234. These components of the alternative die supporting assembly 230 are very similar to the assembly 30, particularly as shown in FIG. 7. Therefore, for the sake of brevity, additional description of the chase 232 and the die plate 234 will be avoided.

The die supporting assembly 230 also includes a releasing assembly 236 for selectively disengaging the securement between the chase 232 and the die plate 234. Additional components of the alternative die supporting assembly 230 are also similar in many respects to those of the assembly 30, with similar elements being similarly numbered to the extent possible for convenience and generally maintaining the orientation described above. For the sake of brevity, the description of the second embodiment will focus on the distinctions between elements of the releasing assembly 236, with an understanding of the common components being apparent to one of ordinary skill in the art from the description above.

The releasing assembly 236 broadly includes a plurality of cams 800, each cam 800 comprising a lobe 802 including a die engaging portion 808 and being connected to an adequately supported and journaled rotational member 804 and disposed within a recess 806 of the chase 232. The rotational members 804 are each connected to a source of rotational movement (not shown) and configured to move between a recessed position (shown in FIG. 19) and an extended position (shown in FIG. 20). When the cam 800 is in the recessed position, the die engaging portion 808 of the cam 800, particularly the lobe 802, is below the engagement surface 240 of the chase 232 and the die plate 234 can be disposed flushly against and magnetically secured to the chase 232. Conversely, upon actuation of the source of rotational movement (not shown), the cam 800 is moved to the extended position, wherein the die engaging portion 808 of the cam 800, particularly the lobe 802, extends above the engagement surface 240 of the chase 232 so that a disengagement force is exerted against the bottom surface 272 of the die plate 234.

The disengagement force applied to the die plate 234 by the die engaging portion 808 of the lobe 802 of the cam 800 is sufficient to disengage the magnetic securement between the die plate 234 and the chase 232. As will be appreciated by one of ordinary skill in the art upon review of this disclosure, the degree to which the die plate 234 is lifted above the chase 232 is controlled by the selected dimensions of the cam 800 and can be controlled by sizing the cam 800 and the die engaging portion 808, particularly the lobe 802, appropriately. It is also noted that the extended position of the cam 800 shown in FIG. 20 includes rotating the cam 800 over center, through a position of maximum extension (at which the lobe 802 projects upwardly beyond the engagement surface 240 further than it does in the extended position), such that the cam 800 will remain in the extended position even after removal of the source of rotational movement (not shown). In this way, the die plate 234 will float above the chase 232 so that it can be shifted relative thereto. At such time as the plates are properly aligned, the source of rotational movement (not shown) can then be actuated to turn in the opposite direction and move the cam 800 from the extended position to the recessed position, whereby the die plate 234 is again magnetically secured to the chase 232.

It is noted that the provision of the specific recessed and extended positions provide the releasing assembly 236 with reliable performance, wherein the movement translated to the die plate 234 is the same every time. It is also specifically noted that it is within the ambit of the present invention to provide the embodiment of FIGS. 19 and 20 with a single source of rotational motion, such that one source controls the movement of all of the cams 800 by a single shaft, or to provide a plurality of individual sources of rotational motion (such as individual electric motors), such that each rotational member 804 is independently controlled. Additionally, it is contemplated to fabricate at least the die engaging portion 808 of the cam 800 from a low friction material such that frictional drag is reduced when shifting the die plate 234 relative to the chase 232 along the lobe of the cam 800.

With reference now to FIGS. 21 and 22, yet another embodiment of a graphic arts die supporting assembly 330 is depicted, generally including a similar chase 332 and a similar die plate 334 including a die carrier plate 335 supporting dies 382. The chase 332 and the die plate 334 are selectively secured to one another by a magnetic attraction, causing contact between an engagement surface 340 of the chase 332 and a bottom surface 372 of the die plate 334. These components of the alternative die supporting assembly 330 are very similar to the assembly 30, particularly as shown in FIG. 7. Therefore, for the sake of brevity, additional description of the chase 332 and the die plate 334 will be avoided.

The die supporting assembly 330 also includes a releasing assembly 336 for selectively disengaging the securement between the chase 332 and the die plate 334. Additional components of the alternative die supporting assembly 330 are also similar in many respects to those of the assembly 30, with similar elements being similarly numbered to the extent possible for convenience and generally maintaining the orientation described above. For the sake of brevity, the description of the second embodiment will focus on the distinctions between elements of the releasing assembly 336, with an understanding of the common components being apparent to one of ordinary skill in the art from the description above.

The releasing assembly 336 broadly comprises at least one bar or cam element 900, each bar 900 including an upper contacting surface 902 including a die engaging portion 916 and an opposed lower surface 904, wherein the lower surface 904 includes at least one angular extending protrusion 906. Each bar 900 is disposed within a recess 908 of the chase 332, wherein the recess 908 includes at least one angular extending surface 910 corresponding to the angular extending protrusion 906 of the bar 900. The bar 900 is connected to a source of lateral movement (not shown) and configured to move between a recessed position (shown in FIG. 21) and an extended position (shown in FIG. 22). When the bar 900 is in the recessed position, the die engaging portion 916 of the upper contacting surface 902 is below the engagement surface 340 of the chase 332 and the die plate 334 can be disposed flushly against and magnetically secured to the chase 332. Conversely, upon actuation of the source of lateral movement (not shown), the bar 900 is moved to the extended position, wherein the angular extending protrusion 906 of the bar 900 engages the corresponding angular extending surface 910 of the recess 908 to raise the upper contacting surface 902 of the bar 900 above the engagement surface 340. In such an extended position, the die engaging portion 916 of the upper contacting surface 902 of the bar 900 exerts a disengagement force against the bottom surface 372 of the die plate 334.

It is briefly noted that the lateral movement of the bar 900 upon actuation may also cause the die plate 334 to be shifted laterally (in addition to moving upward) relative to the chase 332, but such lateral movement can be accommodated by predetermining the extent of the lateral movement prior to realignment of the die plate 334.

The disengagement force applied to the die plate 334 by the upper contacting surface 902 of the bar 900 is sufficient to disengage the magnetic securement between the die plate 334 and the chase 332. As will be appreciated by one of ordinary skill in the art upon review of this disclosure, the degree to which the die plate 334 is lifted above the chase 332 is controlled by the selected dimensions of the bar 900 and can be controlled by configuring the movement of the bar 900 relative to the chase 332 appropriately. It is noted that the engagement position of the bar 900 shown in FIG. 22 includes laterally shifting the bar 900 until a bump end 912 of the bar 900 contacts a stop wall 914 of the recess 908 in the chase 332 such that the bar 900 will not move past the extended position. It is also noted that the bar 900 will remain in the extended position even after the source of lateral movement (not shown) is removed, but not reversed. In this way, the die plate 334 will float above the chase 332 so that it can be shifted relative thereto. At such time as the plates are properly aligned, the source of lateral movement (not shown) can then be reversed and actuated to move in the opposite direction and move the bar 900 from the extended position to the recessed position, whereby the die plate 334 is again magnetically secured to the chase 332.

It is noted that the provision of the specific recessed and extended positions provide the releasing assembly 336 with reliable performance, wherein the movement translated to the die plate 334 is the same every time. It is also specifically noted that it is within the ambit of the present invention to provide the embodiment of FIGS. 21 and 22 with a single source of lateral motion, such that one source controls the movement of all of the bars 900 by a single input, or to provide a plurality of individual sources of lateral motion, such that each bar 900 is independently controlled. Additionally, it is contemplated to fabricate at least the die engaging portion 916 of the upper contacting surface 902 of each bar 900 from a low friction material such that frictional drag is reduced when shifting the die plate 334 relative to the chase 332 along the upper contacting surface 902 of each bar 900 when in the extended position. The use of such a low friction material may also reduce the lateral shifting of the die plate 334 described above, as this material would permit relative shifting between the upper contacting surface 902 of the bar 900 and the die plate 334.

Additionally, with reference now to FIG. 23, a further embodiment of the assembly is disclosed, particularly including an alternative die plate 144. It is noted that this embodiment includes the chase 32 and the releasing assembly 36 of FIGS. 1-12 and, furthermore, that the alternative die plate 144 is similar in many respects to the die plate 34, differing only in size and method of alignment on the chase 32. As discussed above, a die plate used with the present invention need not be substantially the same size in length and width as the chase 32, and alternative die plate 144 is an example of a smaller dimensioned die plate. The smaller size of alternative die plate 144 allows for smaller press jobs to be performed using the chase 32 of the present system, or for the use of multiple such smaller die plates 144 simultaneously.

The alternative die plate 144 includes a top surface 146 and an opposed bottom surface 148. The plate 144 also presents a first pair of opposed side portions 150, 152 and a second pair of opposed side portions 154, 156, cooperating to define the outer margins of the plate 144. In the illustrated embodiment of FIG. 23, the alternative die plate 144 includes a die carrier plate 157 that is adapted to support a plurality of engraved dies 82 on the top surface 146 thereof, in like manner as described above with respect to the die carrier plate 81. Also like plate 81, the alternative die carrier plate 157 is made of a ferromagnetic material, such as steel, and provides for secure attachment to the engagement surface 40 of the chase 32 by the magnetic force of the magnet assemblies 52 within the chase 32 when the bottom surface 148 of the alternative die carrier plate 157 and the engagement surface 40 of the chase 32 are in contacting disposition.

As will be appreciated by one of ordinary skill in the art, the alternative die carrier plate 157 must also be registered in proper position on the chase 32 when the two plates are securely attached to one another by the magnetic force therebetween. Such disposition in proper registration is at least partially accomplished by the receipt of one or more of the alignment pin assemblies 54 protruding from the chase 32 in respective alignment slots 158 within the alternative die carrier plate 157, similar to the embodiment described in more detail above.

In addition, as will be recognized by one of ordinary skill in the art, the smaller size of the alternative die carrier plate 157 relative to the chase 32 may make it difficult to sufficiently register the alternative die carrier plate 157 in proper alignment. Such difficulty in registration would be even more pronounced with a die plate of even smaller size than that of alternative die carrier plate 157, for example an individual bimetallic die, wherein such plate may not register with sufficient, or even any, of the alignment pin assemblies 54. To facilitate proper registration of such alternative plates, such as the alternative die carrier plate 157, a plurality of edge alignment pins 160 are provided, wherein the edge alignment pins 160 are received within the edge additional alignment pin receiving holes 58 of the chase 32. As depicted in FIG. 23, the edge alignment pins 160 are inserted in holes 58 along the sides 44 and 48 of the chase 32, and corresponding sides 150 and 154 of the alternative die carrier plate 157 are positioned to engage the pins 160. Such additional alignment of the alternative die carrier plate 157, used in conjunction with the alignment pin assemblies 54 being received in alignment slots 158 or alone, ensures that the alternative die carrier plate 157 is in proper registration for press operations.

The handles 98 of the embodiment described in more detail above are also detachably secured to the top surface 146 of the alternative die carrier plate 157 to facilitate movement of the alternative die carrier plate 157 during the alignment process, and the handles 98 are secured in like manner as described above. Finally, it is specifically noted that while FIG. 23 depicts the alternative die carrier plate 157 in conjunction with the chase 32 and the releasing assembly 36 of the embodiment illustrated in FIGS. 1-12, such depiction is by example only. The alternative die carrier plate 157, or other such plates of varying size, including a bimetallic die without an additional positioning plate, can also be incorporated in like manner with any of the other embodiments of the present invention described above, as will be readily appreciated by one of ordinary skill in the art upon review of the present disclosure. It is also possible to use the smaller die plate 144 with other forms of the releasing or aligning assemblies, as described herein.

Finally, it is noted that FIGS. 24-27 depict an additional embodiment of some aspects of the present invention, similar in many respects to that depicted in FIGS. 1-12, but incorporating an alternative threaded alignment pin 176 in place of the air-released alignment pin assemblies 54. As will be readily understood by one of ordinary skill in the art upon review of this disclosure, because of the similarities between the embodiments of FIGS. 1-12 and FIGS. 24-27, only the differences relating to the alternative threaded alignment pins 176 will be described in detail, with the knowledge that a proper understanding of the other elements of the assembly can be ascertained by the foregoing description. In fact, it is specifically noted that the alternative threaded alignment pins 176 can be used with the chase 32, the die plate 34, and the releasing assembly 36 of the primary embodiment, and such use is illustrated in FIGS. 24-27.

With particular reference now to FIG. 24, the chase 32 includes a plurality of threaded alignment pins 176, each threadably received within a hole 178. It is specifically noted that the holes 178 are similar in many respects to the holes 56 of the primary embodiment, with distinction here being made primarily as to the number and pattern of the holes 178, and using a distinct reference numeral for clarity in the context of this embodiment. As will be readily understood by one of ordinary skill in the art upon review of this disclosure, the threaded alignment pins 176 could also be received in the holes 56 without departing from the teachings of the present invention.

It is noted that the threaded alignment pins 176 are disposed in approximate double rows extending substantially along the midpoints of opposing sides 44, 46 and 48, 50 of the chase 32. This arrangement includes a total of sixty-four threaded alignment pins 176 and matched holes 178. It is also noted with respect to the threaded alignment pins 176 that the enlarged view of FIG. 25 shows a threaded alignment pin 176 in a projecting position 180 and a threaded alignment pin 176 in a retracted position 182. Movement of the pins 176 between projecting and retracted positions is accomplished simply by screwing each pin 176 into or out of the respective hole 178. It is further noted that additional details of the depicted threaded alignment pins 176 and matched holes 178 are illustrated in FIG. 27.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and access the reasonably fair scope of the present invention as pertains to any apparatus not materially departing from but outside the literal scope of the invention set forth in the following claims.

What is claimed is:

1. A graphic arts die assembly for mounting on a graphic arts impression apparatus, said assembly comprising:

a die plate formed at least partially of ferromagnetic material and including a die; and a chase including a plurality of magnet assemblies disposed along an engagement surface thereof, said die plate and magnet assemblies being configured to provide a magnetic coupling force for selectively securing the die plate to said engagement surface of the chase such that relative movement between the chase and the die plate is restricted during such magnetic securement, said chase including an actuatable releasing assembly operable to exert a disengagement force in opposition to the magnetic coupling force so as to selectively lift the die plate from the chase when the releasing assembly is actuated, thereby releasing the magnetic securement between the chase and the die plate and facilitating relative movement therebetween, said releasing assembly comprising a shiftable element with a die plate engaging portion operable to move between a recessed position, wherein the die plate engaging portion of the shiftable element is below the engagement surface of the chase, and an extended position, wherein the die plate engaging portion of the shiftable element extends above the engagement surface of the chase, said releasing assembly further including a drive system to move the shiftable element to the extended position, said disengagement force being exerted by the die plate engaging portion of the shiftable element when moved to the extended position, with the die plate engaging portion pushing upwardly against the die plate to lift the plate.

2. The graphic arts die assembly as claimed in claim 1, said shiftable element comprising a reciprocating piston, at least part of which defines the die plate engaging portion.

3. The graphic arts die assembly as claimed in claim 2, said releasing assembly further including a stop disposed within the chase, such that contact between the stop and a corresponding portion of the piston defines an uppermost extended position and restricts further upward movement of the piston.

4. The graphic arts die assembly as claimed in claim 3, said die plate engaging portion of the piston being generally convex.

5. The graphic arts die assembly as claimed in claim 2, said drive system including a pressurized fluid manifold within the chase to associate a pressurized fluid with the piston, such that the pressurized fluid is caused to provide an extension force that urges the piston into the extended position.

6. The graphic arts die assembly as claimed in claim 5, said manifold being configured for use with compressed air.

7. The graphic arts die assembly as claimed in claim 6, said releasing assembly further including a coupler connectable to a source of compressed air, said coupler being removably secured to the chase.

8. The graphic arts die assembly as claimed in claim 5, said releasing assembly further including a return spring to bias the piston toward the recessed position.

9. The graphic arts die assembly as claimed in claim 8, said releasing assembly including a plurality of pistons disposed within the chase, said plurality of pistons being substantially evenly spaced at discrete locations along the engagement surface of the chase, said manifold including a plurality of passageways within the chase for associating the pressurized fluid with the plurality of pistons.

10. The graphic arts die assembly as claimed in claim 1, said shiftable element comprising a cam element, said disengagement force being exerted by at least a portion of the cam element pushing upwardly against the die plate to lift the plate.

11. The graphic arts die assembly as claimed in claim 10, said releasing assembly further including a stop disposed within the chase, such that contact between the stop and a corresponding portion of the cam member defines a fully engaged position, wherein the cam element is in the extended position, and further movement of the cam element is restricted.

12. The graphic arts die assembly as claimed in claim 11, said cam element comprising a rotatable cam including a lobe, said disengagement force being exerted by at least a portion of the lobe pushing upwardly against the die plate to lift the plate.

13. The graphic arts die assembly as claimed in claim 12, said cam being rotatable between the recessed position, through a position of maximum extension at which the lobe is at its highest point above the engagement surface of the chase, to the fully engaged position.

14. The graphic arts die assembly as claimed in claim 13, said fully engaged position of the rotatable cam being over center, such that the lobe is lower at the fully engaged position than at the position of maximum extension.

15. The graphic arts die assembly as claimed in claim 14, said releasing assembly including a plurality of rotatable cams including lobes disposed within the chase, said plurality of cam lobes being substantially evenly spaced at discrete locations along the engagement surface of the chase.

16. The graphic arts die assembly as claimed in claim 15, said drive system including a rotatable shaft, said releasing assembly further including at least a subset of the plurality of rotatable cams carried on the shaft.

17. The graphic arts die assembly as claimed in claim 10, said cam element including at least one angularly extending cam surface, said releasing assembly including at least one angularly extending follower surface configured to cooperate with the cam surface to shift the cam element between the recessed and extended positions when the surfaces are shifted laterally relative to one another.

18. The graphic arts die assembly as claimed in claim 17, said cam element being shiftable laterally, said follower surface being defined on the chase and thereby being fixed.

19. The graphic arts die assembly as claimed in claim 17, said releasing assembly including a plurality of slidable members disposed within the chase, said plurality of slidable members being substantially evenly spaced at discrete locations along the engagement surface of the chase.

20. The graphic arts die assembly as claimed in claim 1, said die plate comprising a die carrier plate that presents a chase engaging surface and an opposite die engaging surface, said die engaging surface being configured to receive a plurality of dies in aligned disposition thereon.

21. The graphic arts die assembly as claimed in claim 20, said die carrier plate including a plurality of threaded studs thereon, each of said threaded studs projecting from the die engaging surface, each of said dies including at least a pair of alignment holes therethrough, each configured to receive a respective one of the threaded studs therein for alignment of the die on the die carrier plate.

22. The graphic arts die assembly as claimed in claim 21; and a handle removably attached to said die carrier plate.

23. The graphic arts die assembly as claimed in claim 21, said die engaging surface of the die carrier plate being substantially the same size as the engagement surface of the chase.

24. The graphic arts die assembly as claimed in claim 1, said chase including a plurality of alignment assemblies to facilitate disposition of the die plate on the support in aligned registration, each alignment assembly comprising a reciprocating pin with a die plate aligning portion operable to move between a projecting position, wherein the die plate aligning portion of the pin projects upwardly from the engagement surface of the chase, and a retracted position, wherein the die plate aligning portion of the pin is below the engagement surface of the chase.

25. The graphic arts die assembly as claimed in claim 24, each of said alignment assemblies including a pin stop disposed within the chase, such that contact between the stop and a corresponding portion of the pin defines an uppermost projecting position and restricts further upward movement of the pin.

26. The graphic arts die assembly as claimed in claim 25, each of said alignment assemblies further including an activation spring to bias the pin toward the projecting position against the pin stop; and an actuatable return system to move the pin to the retracted position.

27. The graphic arts die assembly as claimed in claim 1, said chase including a plurality of alignment pins and a plurality of alignment pin receiving holes, each hole adapted to selectively receive a respective one of the alignment pins therein.

28. The graphic arts die assembly as claimed in claim 27, each of said alignment pins having a die plate aligning portion operable to move between a projecting position, wherein the die plate aligning portion of the pin projects upwardly from the engagement surface of the chase, and a retracted position, wherein the die plate aligning portion of the pin is below the engagement surface of the chase.

29. The graphic arts die assembly as claimed in claim 28, said alignment pin being threadably received within the receiving holes.

30. The graphic arts die assembly as claimed in claim 1, said magnet assemblies comprising samarium-cobalt magnets.

31. The graphic arts die assembly as claimed in claim 1; and a handle selectively attached to said chase to facilitate movement of the chase onto a platen of a press.

32. A graphic arts die assembly for mounting on a graphic arts impression apparatus, said assembly comprising:

a die plate formed at least partially of ferromagnetic material and including a die; and a chase including a plurality of magnet assemblies disposed along an engagement surface thereof, said die plate and magnet assemblies being configured to provide a magnetic coupling force for selectively securing the die plate to said engagement surface of the chase such that relative movement between the chase and the die plate is restricted during such magnetic securement, said chase including an actuatable releasing assembly operable to exert a disengagement force in opposition to the magnetic coupling force so as to selectively lift the die plate from the chase when the releasing assembly is actuated, thereby releasing the magnetic securement between the chase and the die plate and facilitating relative movement therebetween, said releasing assembly comprising a shiftable element with a die plate engaging portion operable to move between a recessed position, wherein the die plate engaging portion of the shiftable element is below the engagement surface of the chase, and an extended position, wherein the die plate engaging portion of the shiftable element extends above the engagement surface of the chase, said releasing assembly further including a drive system to move the shiftable element to the extended position, said disengagement force being exerted by the die plate engaging portion of the shiftable element when moved to the extended position, with the die plate engaging portion pushing upwardly against the die plate to lift the plate, said shiftable element a which defines the die plate engaging portion, said releasing assembly including a plurality of pistons disposed within the chase, at least one of said reciprocating pistons comprising a lifting portion, at least part of which defines the die plate engaging portion, and a die plate aligning portion to facilitate disposition of the die plate on the chase in aligned registration, said die plate aligning portion projecting upwardly from the engagement surface of the chase when the at least one reciprocating piston is in the recessed and extended positions.

33. The graphic arts die assembly as claimed in claim 32, said at least one reciprocating piston comprising a generally elongated body with the lifting portion and the die plate aligning portion being generally coaxial, said die plate aligning portion being radially inward of and extending axially beyond the lifting portion to define a lifting shoulder, said lifting shoulder comprising the die plate engaging portion of the at least one reciprocating piston.

34. A graphic arts die assembly for mounting on a graphic arts impression apparatus, said assembly comprising:

a die plate formed at least partially of ferromagnetic material and including a die; and a chase including a plurality of magnet assemblies disposed along an engagement surface thereof, said die plate and magnet assemblies being configured to provide a magnetic coupling force for selectively securing the die plate to said engagement surface of the chase such that relative movement between the chase and the die plate is restricted during such magnetic securement, said chase including an actuatable releasing assembly operable to exert a disengagement force in opposition to the magnetic coupling force so as to selectively lift the die plate from the chase when the releasing assembly is actuated, thereby releasing the magnetic securement between the chase and the die plate and facilitating relative movement therebetween, said releasing assembly comprising a shiftable element with a die plate engaging portion operable to move between a recessed position, wherein the die plate engaging portion of the shiftable element is below the engagement surface of the chase, and an extended position, wherein the die plate engaging portion of the shiftable element extends above the engagement surface of the chase, said releasing assembly further including a drive system to move the shiftable element to the extended position, said disengagement force being exerted by the die plate engaging portion of the shiftable element when moved to the extended position, with the die plate engaging portion pushing upwardly against the die plate to lift the plate, said shiftable element comprising a reciprocating piston, at least part of which defines the die plate engaging portion, said drive system including a pressurized fluid manifold within the chase to associate a pressurized fluid with the piston, such that the pressurized fluid is caused to provide an extension force that urges the piston into the extended position, said chase further including a plurality of alignment assemblies to facilitate disposition of the die plate on the chase in aligned registration, each alignment assembly comprising a reciprocating pin with a die plate aligning portion operable to move between a projecting position, wherein the die plate aligning portion of the pin projects upwardly from the engagement surface of the chase, and a retracted position, wherein the die plate aligning portion of the pin is below the engagement surface of the chase.

35. The graphic arts die assembly as claimed in claim 34, each of said alignment assemblies including a pin stop disposed within the chase, such that contact between the stop and a corresponding portion of the pin defines an uppermost projecting position and restricts further upward movement of the pin.

36. The graphic arts die assembly as claimed in claim 35, each of said alignment assemblies further including an activation spring to bias the pin toward the projecting position against the pin stop; and an actuatable return system to move the pin to the retracted position.

37. The graphic arts die assembly as claimed in claim 34, said releasing assembly including a plurality of reciprocating pistons disposed within the chase, at least some of said pistons comprising a generally elongated hollow body, each alignment assembly corresponding with one of the hollow piston bodies to form a piston and pin assembly with the pin at least partially received within the hollow body of the corresponding piston, said pin being configured for reciprocating movement within the corresponding piston along a common line of movement with the corresponding piston, said pin being configured for reciprocating movement independent of the movement of the corresponding piston.

38. The graphic arts die assembly as claimed in claim 37, each of said pins comprising a generally elongated body, said corresponding pin and piston of each piston and pin assembly being generally coaxial.

39. The graphic arts die assembly as claimed in claim 38, each of said alignment assemblies including a pin stop disposed within the body of the corresponding piston, such that contact between the stop and a corresponding portion of the pin defines an uppermost projecting position and restricts further upward movement of the pin, each of said alignment assemblies further including an activation spring to bias the pin toward the projecting position against the pin stop.

40. The graphic arts die assembly as claimed in claim 39, said releasing assembly including a plurality of return springs, each of which is associated with one of the pistons and configured to bias the one piston toward the recessed position.

41. A chase for supporting a die plate formed at least partially of ferromagnetic material in a graphic arts impression apparatus, said chase comprising:

a body presenting an engagement surface configured to engage the die plate;

a plurality of magnet assemblies disposed along the engagement surface of the body, such that a magnetic coupling force is provided to selectively secure the die plate to the engagement surface of the body such that relative movement between the body and the die plate is restricted during such magnetic securement; and an actuatable releasing assembly operable to exert a disengagement force in opposition to the magnetic coupling force so as to selectively lift the die plate from the body when the releasing assembly is actuated, thereby releasing the magnetic securement between the chase and the die plate and facilitating relative movement therebetween, said releasing assembly comprising a shiftable element with a die plate engaging portion operable to move between a recessed position, wherein the die plate engaging portion of the shiftable element is below the engagement surface of the body, and an extended position, wherein the die plate engaging portion of the shiftable element extends above the engagement surface of the body, said releasing assembly further including a drive system to move the shiftable element to the extended position, said disengagement force being exerted by the die plate engaging portion of the shiftable element when moved to the extended position, with the die plate engaging portion configured to push upwardly against the die plate to lift the plate.

42. The chase as claimed in claim 41, said shiftable element comprising a reciprocating piston, at least part of which defines the die plate engaging portion.

43. The chase as claimed in claim 42, said releasing assembly further including a stop disposed within the body, such that contact between the stop and a corresponding portion of the piston defines an uppermost extended position and restricts further upward movement of the piston.

44. The chase as claimed in claim 43, said die plate engaging portion of the piston being generally convex.

45. The chase as claimed in claim 42, said drive system including a pressurized fluid manifold within the body to associate a pressurized fluid with the piston, such that the pressurized fluid is caused to provide an extension force that urges the piston into the extended position.

46. The chase as claimed in claim 45, said manifold being configured for use with compressed air.

47. The chase as claimed in claim 46, said releasing assembly further including a coupler connectable to a source of compressed air, said coupler being removably secured to the body.

48. The chase as claimed in claim 45, said releasing assembly further including a return spring to bias the piston toward the recessed position.

49. The chase as claimed in claim 48, said releasing assembly including a plurality of pistons disposed within the body, said plurality of pistons being substantially evenly spaced at discrete locations along the engagement surface of the body, said manifold including a plurality of passageways within the body for associating the pressurized fluid with the plurality of pistons.

50. The chase as claimed in claim 41, said shiftable element comprising a cam element, said disengagement force being exerted by at least a portion of the cam element configured to push upwardly against the die plate to lift the plate.

51. The chase as claimed in claim 50, said releasing assembly further including a stop disposed within the body, such that contact between the stop and a corresponding portion of the cam member defines a fully engaged position, wherein the cam element is in the extended position, and further movement of the cam element is restricted.

52. The chase as claimed in claim 51, said cam element comprising a rotatable cam including a lobe, said disengagement force being exerted by at least a portion of the lobe configured to push upwardly against the die plate to lift the plate.

53. The chase as claimed in claim 52, said cam being rotatable between the recessed position, through a position of maximum extension at which the lobe is at its highest point above the engagement surface of the body, to the fully engaged position.

54. The chase as claimed in claim 53, said fully engaged position of the rotatable cam being over center, such that the lobe is lower at the fully engaged position than at the position of maximum extension.

55. The chase as claimed in claim 54, said releasing assembly including a plurality of rotatable cams including lobes disposed within the body, said plurality of cam lobes being substantially evenly spaced at discrete locations along the engagement surface of the body.

56. The chase as claimed in claim 55, said drive system including a rotatable shaft, said releasing assembly further including at least a subset of the plurality of rotatable cams carried on the shaft.

57. The chase as claimed in claim 50, said cam element including at least one angularly extending cam surface, said releasing assembly including at least one angularly extending follower surface configured to cooperate with the cam surface to shift the cam element between the recessed and extended positions when the surfaces are shifted laterally relative to one another.

58. The chase as claimed in claim 57, said cam element being shiftable laterally, said follower surface being defined on the body and thereby being fixed.

59. The chase as claimed in claim 57, said releasing assembly including a plurality of slidable members disposed within the body, said plurality of slidable members being substantially evenly spaced at discrete locations along the engagement surface of the body.

60. The chase as claimed in claim 41, said body including a plurality of alignment assemblies operable to facilitate disposition of the die plate on the support in aligned registration, each alignment assembly comprising a reciprocating pin with a die plate aligning portion operable to move between a projecting position, wherein the die plate aligning portion of the pin projects upwardly from the engagement surface of the body, and a retracted position, wherein the die plate aligning portion of the pin is below the engagement surface of the body.

61. The chase as claimed in claim 60, each of said alignment assemblies including a pin stop disposed within the body, such that contact between the stop and a corresponding portion of the pin defines an uppermost projecting position and restricts further upward movement of the pin.

62. The chase as claimed in claim 61, each of said alignment assemblies further including an activation spring to bias the pin toward the projecting position against the pin stop; and an actuatable return system to move the pin to the retracted position.

63. The chase as claimed in claim 41, said body including a plurality of alignment pins and a plurality of alignment pin receiving holes, each hole adapted to selectively receive a respective one of the alignment pins therein.

64. The chase as claimed in claim 63, each of said alignment pins having a die plate aligning portion operable to move between a projecting position, wherein the die plate aligning portion of the pin projects upwardly from the engagement surface of the body, and a retracted position, wherein the die plate aligning portion of the pin is below the engagement surface of the body.

65. The chase as claimed in claim 64, said alignment pin being threadably received within the receiving holes.

66. The chase as claimed in claim 41, said magnet assemblies comprising samarium-cobalt magnets.

67. The chase as claimed in claim 41; and a handle selectively attached to said body to facilitate movement of the body onto a platen of a press.

68. A chase for supporting a die plate formed at least partially of ferromagnetic material in a graphic arts impression apparatus, said chase comprising:

a body presenting an engagement surface configured to engage the die plate;

a plurality of magnet assemblies disposed along the engagement surface of the body, such that a magnetic coupling force is provided to selectively secure the die plate to the engagement surface of the body such that relative movement between the body and the die plate is restricted during such magnetic securement; and an actuatable releasing assembly operable to exert a disengagement force in opposition to the magnetic coupling force so as to selectively lift the die plate from the body when the releasing assembly is actuated, thereby releasing the magnetic securement between the chase and the die plate and facilitating relative movement therebetween, said releasing assembly comprising a shiftable element with a die plate engaging portion operable to move between a recessed position, wherein the die plate engaging portion of the shiftable element is below the engagement surface of the body, and an extended position, wherein the die plate engaging portion of the shiftable element extends above the engagement surface of the body, said releasing assembly further including a drive system to move the shiftable element to the extended position, said disengagement force being exerted by the die plate engaging portion of the shiftable element when moved to the extended position, with the die plate engaging portion configured to push upwardly against the die plate to lift the plate, said shiftable element comprising a reciprocating piston, at least part of which defines the die plate engaging portion, said releasing assembly including a plurality of pistons disposed within the body, at least one of said reciprocating pistons comprising a lifting portion, at least part of which defines the die plate engaging portion, and a die plate aligning portion to facilitate disposition of the die plate on the chase in aligned registration, said die plate aligning portion projecting upwardly from the engagement surface of the chase when the at least one reciprocating piston is in the recessed and extended positions.

69. The chase as claimed in claim 68, said at least one reciprocating piston comprising a generally elongated body with the lifting portion and the die plate aligning portion being generally coaxial, said die plate aligning portion being radially inward of and extending axially beyond the lifting portion to define a lifting shoulder, said lifting shoulder comprising the die plate engaging portion of the at least one reciprocating piston.

70. A chase for supporting a die plate formed at least partially of ferromagnetic material in a graphic arts impression apparatus, said chase comprising:

a body presenting an engagement surface configured to engage the die plate;

a plurality of magnet assemblies disposed along the engagement surface of the body, such that a magnetic coupling force is provided to selectively secure the die plate to the engagement surface of the body such that relative movement between the body and the die plate is restricted during such magnetic securement; and an actuatable releasing assembly operable to exert a disengagement force in opposition to the magnetic coupling force so as to selectively lift the die plate from the body when the releasing assembly is actuated, thereby releasing the magnetic securement between the chase and the die plate and facilitating relative movement therebetween, said releasing assembly comprising a shiftable element with a die plate engaging portion operable to move between a recessed position, wherein the die plate engaging portion of the shiftable element is below the engagement surface of the body, and an extended position, wherein the die plate engaging portion of the shiftable element extends above the engagement surface of the body, said releasing assembly further including a drive system to move the shiftable element to the extended position, said disengagement force being exerted by the die plate engaging portion of the shiftable element when moved to the extended position, with the die plate engaging portion configured to push upwardly against the die plate to lift the plate, said shiftable element comprising a reciprocating piston, at least part of which defines the die plate engaging portion, said drive system including a pressurized fluid manifold within the body to associate a pressurized fluid with the piston, such that the pressurized fluid is caused to provide an extension force that urges the piston into the extended position, said body further including a plurality of alignment assemblies operable to facilitate disposition of the die plate on the body in aligned registration, each alignment assembly comprising a reciprocating pin with a die plate aligning portion operable to move between a projecting position, wherein the die plate aligning portion of the pin projects upwardly from the engagement surface of the body, and a retracted position, wherein the die plate aligning portion of the pin is below the engagement surface of the body.

71. The chase as claimed in claim 70, each of said alignment assemblies including a pin stop disposed within the body, such that contact between the stop and a corresponding portion of the pin defines an uppermost projecting position and restricts further upward movement of the pin.

72. The chase as claimed in claim 71, each of said alignment assemblies further including an activation spring to bias the pin toward the projecting position against the pin stop; and an actuatable return system to move the pin to the retracted position.

73. The chase as claimed in claim 70, said releasing assembly including a plurality of reciprocating pistons disposed within the body, at least some of said pistons comprising a generally elongated hollow piston body, each alignment assembly corresponding with one of the hollow piston bodies to form a piston and pin assembly with the pin at least partially received within the hollow piston body of the corresponding piston, said pin being configured for reciprocating movement within the corresponding piston along a common line of movement with the corresponding piston, said pin being configured for reciprocating movement independent of the movement of the corresponding piston.

74. The chase as claimed in claim 73, each of said pins comprising a generally elongated pin body, said corresponding pin and piston of each piston and pin assembly being generally coaxial.

75. The chase as claimed in claim 74, each of said alignment assemblies including a pin stop disposed within the piston body of the corresponding piston, such that contact between the stop and a corresponding portion of the pin defines an uppermost projecting position and restricts further upward movement of the pin, each of said alignment assemblies further including an activation spring to bias the pin toward the projecting position against the pin stop.

76. The chase as claimed in claim 75, said releasing assembly including a plurality of return springs, each of which is associated with one of the pistons and configured to bias the one piston toward the recessed position.

* * * * *